US005227272A

United States Patent [19]

Kato

[11] Patent Number: 5,227,272

[45] Date of Patent: Jul. 13, 1993

[54] ELECTROPHOTOGRAPHIC LIGHT-SENSITIVE MATERIAL

[75] Inventor: Eiichi Kato, Shizuoka, Japan

[73] Assignee: Fuji Photo Film Co., Ltd., Kanagawa, Japan

[21] Appl. No.: 625,239

[22] Filed: Dec. 10, 1990

[30] Foreign Application Priority Data

Dec. 12, 1989 [JP] Japan ..... 1-320639
May 18, 1990 [JP] Japan ..... 2-126782

[51] Int. Cl.[5] ..... G03G 5/087
[52] U.S. Cl. ..... 430/96
[58] Field of Search ..... 430/96

[56] References Cited

U.S. PATENT DOCUMENTS

| | | | |
|---|---|---|---|
| 3,932,181 | 1/1976 | Ray-Chaudhuri et al. | 430/96 |
| 4,105,448 | 8/1978 | Miyatuka et al. . | |
| 4,492,747 | 1/1985 | Brechlin | 430/96 |
| 4,592,980 | 6/1986 | Tomida et al. | 430/96 |
| 4,871,638 | 10/1989 | Kato et al. | 430/96 |
| 4,954,407 | 6/1991 | Kato et al. . | |
| 4,968,572 | 11/1991 | Kato et al. | 430/96 |
| 4,983,481 | 1/1991 | Yu | 430/58 |
| 4,996,121 | 2/1991 | Kato et al. | 430/96 |
| 5,021,311 | 6/1991 | Kato et al. . | |

FOREIGN PATENT DOCUMENTS

| | | |
|---|---|---|
| 0307227 | 3/1989 | European Pat. Off. . |
| 2537581 | 4/1991 | Fed. Rep. of Germany . |

OTHER PUBLICATIONS

*Block Copolymers*; Allport and Janes; Applied Science Publishers, Ltd., pp. 1-6.
Patent Abstracts of Japan, vol. 13, No. 9.

*Primary Examiner*—Marion E. McCamish
*Assistant Examiner*—Christopher D. RoDee
*Attorney, Agent, or Firm*—Sughrue, Mion, Zinn, Macpeak & Seas

[57] ABSTRACT

An electrophotographic light-sensitive material having a photoconductive layer containing at least an inorganic photoconductive substance and a binder resin, wherein said binder resin contains an AB block copolymer having a weight average molecular weight of from $1\times10^3$ to $2\times10^4$ and composed of a first block comprising at least one polymer component containing at least one acidic group selected from $-PO_3H_2$, $-COOH$, $-SO_3H$, a phenolic hydroxy group, (wherein R represents a hydrocarbon group or —OR' (wherein R' represents a hydrocarbon group)) and a cyclic acid anhydride-containing group, and a second block containing at least a polymer component represented by following formula (I):

(I)

wherein $R_1$ represents a hydrocarbon group.

8 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic characteristics, moisture resistance, and durability.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced.

Binders which are used for forming the photoconductive layer of an electrophotographic light-sensitive material are required to be excellent in the film-forming properties by themselves and the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue before light-exposure and also have an excellent image forming properties, and the photoconductive layer stably maintains these electrostatic properties to change of humidity at the time of image formation.

Further, extensive studies have been made for lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

However, conventional binder resins used for electrophotographic light-sensitive materials have various problems particularly in electrostatic characteristics such as a charging property, dark charge retention, a light sensitivity, etc., and smoothness of the photoconductive layer.

Also, the practical evaluations on conventional binder resins which are said to be developed for electrophotographic lithographic master plates have found that they have problems in the above-described electrostatic characteristics, background staining of prints, etc.

In order to overcome the above problems, JP-A-63-217354 and JP-A-1-70761 (the term "JP-A" as used herein means an "unexamined Japanese patent application") disclose improvements in the smoothness of the photoconductive layer and electrostatic characteristics by using, as a binder resin, a resin having a low molecular weight containing from 0.05 to 10% by weight of a copolymer component containing an acidic group in side chains of the polymer or a resin having a low molecular weight (i.e., a weight average molecular weight (Mw) of from $1\times10^3$ to $1\times10^4$) having an acidic group bonded at only one terminal of the polymer main chain thereby obtaining an image having no background stains.

Also, JP-A-1-100554 and JP-A-1-214865 disclose a technique using, as a binder resin, a resin containing a polymer component containing an acidic group in side chains of the copolymer or at the terminal of the polymer main chain, and containing a polymer component having a heat- and/or photo-curable functional groups; JP-A-1-102573 and JP-A-2-874 disclose a technique using a resin containing an acidic group in side chains of the copolymer or at the terminal of the polymer main chain, and a crosslinking agent in combination; JP-A-64-564, JP-A-63-220149, JP-A-63-220148, JP-A-1-280761, JP-A-1-116643 and JP-A-1-169455 disclose a technique using a resin having a low molecular weight (a weight average molecular weight of from $1\times10^3$ to $1\times10^4$) and a resin having a high molecular weight (a weight average molecular weight of $1\times10^4$ or more) in combination; JP-A-1-211766 and JP-A-2-34859 disclose a technique using the above low molecular weight resin and a heat- and/or photo-curable resin in combination; and JP-A-2-53064, JP-A-2-56558 and JP-A-2-103056 disclose a technique using the above low molecular weight resin and a comb-like polymer in combination. The above prior art references disclose that, according to the proposed technique, the film strength of the photoconductive layer can be increased sufficiently and also the mechanical strength of the light-sensitive material can be increased without adversely affecting the above-described electrostatic characteristics by using a resin containing an acidic group in side chains or at the terminal of the polymer main chain.

However, it has been found that, even in the case of using these resins, it is yet insufficient to keep the stable performance in the case of greatly changing the environmental conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

The present invent-ion has been made for solving the problems of conventional electrophotographic light-sensitive materials as described above and meeting the requirement for the light-sensitive materials.

An object of the present invention is to provide an electrophotographic light-sensitive material having stable and excellent electrostatic characteristics and giving clear good images even when the environmental conditions during the formation of duplicated images are changed to low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of this invention is to provide an electrophotographic lithographic printing plate precursor having excellent electrostatic characteristics (in particular, dark charge retentivity and photosensitivity), capable of reproducing faithful duplicated images to original, forming neither overall background stains nor dotted background stains of prints, and showing excellent printing durability.

Other objects of the present invention will become apparent from the following description and examples.

It has been found that the above described objects of the present invention are accomplished by an electrophotographic light-sensitive material comprising a support having provided thereon a photoconductive layer containing an inorganic photoconductive substance and a binder resin, wherein the binder resin contains an AB block coplymer having a weight average molecular weight of from $1\times10^3$ to $2\times10^4$ and composed of a first block comprising at least one polymer component containing at least one acidic group selected from $-PO_3H_2$, —COOH, $-SO_3H$, a phenolic hydroxy group,

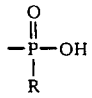

(wherein R represents a hydrocarbon group or -OR′ (wherein R′ represents a hydrocarbon group)) and a cyclic acid anhydride-containing group, and a second block containing at least a polymer component represented by the following formula (I):

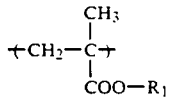

(I)

wherein $R_1$ represents a hydrocarbon group.

Furthermore, it has also been found that the mechanical strength (the printing durability in the case of using as a printing plate) of the electrophotographic light-sensitive material can be further improved, when the binder resin used in the present invention contains (i) the above-described AB block copolymer (resin (A)) composed of a component containing the above-described specific acidic group (unless otherwise indicated, the acidic group includes a cyclic acid anhydride-containing group) and a methacrylate component as the block components and (ii) at least one of a heat- and/or photo-curable resin (resin (B)), a crosslinking agent, a resin (C) shown below, a resin (D) shown below, and a resin (E) shown below.

Resin (C)

A resin having a weight average molecular weight of from $5\times10^4$ to $5\times10^5$ and not containing $-PO_3H_2$, —COOH, $-SO_3H$, phenolic —OH,

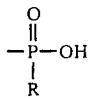

(wherein R is as defined above), a cyclic acid anhydride-containing group and a basic group.

Resin (D)

A resin having a weight average molecular weight of from $5\times10^4$ to $5\times10^5$ and containing from 0.1 to 15% by weight of a copolymer component containing at least one substituent selected from —OH and a basic group.

Resin (E):

A resin having a weight average molecular weight of from $5\times10^4$ to $5\times10^5$ and containing a copolymer component containing the acidic group at a content of not more than 50% of the content of the acidic group contained in the above-described AB block copolymer (resin (A)), or a resin having a weight average molecular weight of from $5\times10^4$ to $5\times10^5$ and containing a copolymer component containing at least one acidic group which has a pKa higher than the pKa of the acidic group contained in the above-described AB block copolymer (resin (A)) and which is selected from $-PO_3H_2$, $-SO_3H$, —COOH, and

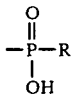

(wherein R represents a hydrocarbon group or $-OR_o$ (wherein $R_o$ represents a hydrocarbon group)).

DETAILED DESCRIPTION OF THE INVENTION

The resin (A) used in the present invention is an A-B type block copolymer, one block (A block) is composed of at least one polymer component containing at least one acidic group selected from the above-described specific acidic groups and the other block (B block) is composed of a polymer component containing at least one of the methacrylate components represented by the formula (I) described above, and the resin (A) has a weight average molecular weight of from $1\times10^3$ to $2\times10^4$.

The conventional low molecular weight resin in acidic group-containing binder resins which were known to improve the smoothness and the electrostatic characteristics of the above-described photoconductive layer was a resin wherein acidic group-containing polymer components randomly exist in the polymer main chain, or a resin wherein an acidic group was bonded to only one terminal of the polymer main chain.

On the other hand, the resin (A) used for the binder resin of the present invention is a copolymer wherein the acidic groups contained in the resin do not randomly exist in the polymer main chain or the acidic group is not bonded to one terminal of the polymer main chain, but the acidic group is further specified in such a manner that the acidic group exists as a block in the polymer main chain.

It is presumed that, in the copolymer (resin (A)) used in the present invention, the domain of the portion of the acidic group bonded to one terminal portion of the main chain of the polymer is sufficiently adsorbed on the stoichiometric defect of the inorganic photoconductive substance and other block portion constituting the polymer main chain mildly but sufficiently cover the surface of the photoconductive substance. Also, it is presumed that, even when the stoichiometric defect portion of the inorganic photoconductive substance varies to some extents, it always keeps a stable interaction with the copolymer (resin (A)) used in the present invention since the resin has the aforesaid sufficiently adsorbed domain by the function and mechanism as described above. Thus, it has been found that, according to the present invention, the traps of the inorganic photoconductive substance are more effectively and sufficiently compensated and the humidity characteristics of the photoconductive substance are improved as compared with conventionally known acidic group-containing resins. Further, in the present invention, particles of the inorganic photoconductive substance are sufficiently dispersed in the binder to restrain the occurrence of the aggregation of the particles of the photoconductive substance as well as even when the environmental conditions are greatly changed from high temperature and high humidity to low temperature and low humidity, the electrophotographic characteristics of a high performance can be stably maintained.

Also, when the heat- and/or photo-curable resin (B) and/or a crosslinking agent is used together with the resin (A) in accordance with one preferred embodiment of the present invention, the mechanical strength of the photoconductive layer, which is insufficient by the use of the resin (A) alone, can be sufficiently increased without hindering the above-described high performance of the electrophotographic characteristics. This system is particularly effective in the case of a scanning exposure system using a semiconductor laser. Also, in this case, the smoothness of the surface of the photoconductive layer can be further improved.

If an electrophotographic light-sensitive material having a photoconductive layer of a coarse surface is used as a lithographic printing master plate by an electrophotographic system, the photoconductive layer is formed in a state that the dispersion state of the particles of an inorganic photoconductive substance such as zinc oxide particles and a binder resin is improper and aggregates of the particles exist. When an oil-desensitizing treatment with an oil-desensitizing solution is applied thereto, the non-imaged areas are not uniformly and sufficiently rendered hydrophilic to cause attaching of a printing ink at printing, which results in the formation of background stains at the non-image areas of the prints obtained.

On the other hand, since the resin (A) used in the present invention is a low molecular weight copolymer, there might be a fear that the film strength is weakened. However, it has been found that, by sufficiently dispersing the particles of the photoconductive substance in the binder resin and adsorbing the resin (A) onto the surfaces of the particles to coat them, the electrophotographic light-sensitive material has a sufficient film strength as a CPC electrophotographic light-sensitive material or an offset master plate for printing several thousands prints.

When the resin (A) of the present invention is used, the interaction of the inorganic photoconductive substance and the binder resin for adsorption and coating is adequately conducted and the good film strength of the photoconductive layer is sufficiently maintained.

Furthermore, it has been found that good light-sensitivity can be obtained as compared with a conventional random copolymer resin having an acidic group at the side chain bonded to the main chain of the polymer.

Since spectral sensitizing dyes which are used for giving light sensitivity in the region of visible light to infrared light have a function of sufficiently showing the spectral sensitizing action by adsorbing on photoconductive particles, it can be assumed that the binder resin containing the resin (A) of the present invention makes suitable interaction with photoconductive particles without hindering the adsorption of spectral sensitizing dyes onto the photoconductive particles. This effect is particularly remarkable in cyanine dyes or phthalocyanine dyes which are particularly effective as spectral sensitizing dyes for the region of near infrared to infrared light.

When the low molecular weight resin (A) is used alone for the binder resin in this invention, the binder resin sufficiently adsorbs onto photoconductive particles to cover the surface of the particles, whereby the photoconductive layer formed is excellent in the surface smoothness and electrostatic characteristics, image quality having no background stains is obtained, and further the layer maintains a sufficient film strength for CPC light-sensitive materials or for an offset printing master plate giving several thousands of prints. However, when the resin (B), (C), or (D) is used together with the resin (A) for the binder resin, the mechanical strength of the photoconductive layer, which is yet insufficient by the use of the resin (A) only, can be more improved without reducing the function of the resin (A). Accordingly, the electrophotographic light-sensitive material of the present invention has excellent electrostatic characteristics even when environmental condition is changed, has a sufficient film strength, and, when the light-sensitive material is used as an offset printing master plate after processing, at least 6,000 prints can be obtained under severe printing conditions (e.g., when a printing pressure is high due to the use of a large size printing machine).

The content of the polymer component containing the specific acidic group in the AB block copolymer (resin (A)) of the present invention is preferably from 0.5 to 20 parts by weight, and more preferably from 3 to 15 parts by weight per 100 parts by weight of the copolymer.

If the content of the acidic group in the binder resin (A) is less than 0.5% by weight, the initial potential is low and thus satisfactory image density can not be obtained. On the other hand, if the content of the acidic group is larger than 20% by weight, the dispersibility is reduced, the film smoothness and the electrostatic characteristics under high humidity condition characteristics are reduced, and further when the light-sensitive material is used as an offset master plate, the occurrence of background stains is increased.

The glass transition point of the resin (A) is preferably from −10° C. to 100° C., and more preferably from −5° C. to 85° C.

The content of the methacrylate component shown by the above formula (I) in the block portion (B block) containing the methacrylate component of formula (I) is preferably from 30 to 100% by weight, and more preferably from 50 to 100% by weight based on the total weight of the B block.

The weight average molecular weight of the AB copolymer (resin (A)) is from $1\times10^3$ to $2\times10^4$, and preferably from $2\times10^3$ to $1\times10^4$.

If the weight average molecular weight of the resin (A) is less than $1\times10^3$, the film-forming property of the resin is lowered, thereby a sufficient film strength cannot be maintained, while if the weight average molecular weight of the resin (A) is higher than $2\times10^4$, the effect of the resin (A) of the present invention is reduced, thereby the electrostatic characteristics thereof become almost the same as those of conventionally known resins.

Then, the polymer component containing the specific acidic group, which constitutes one block of the A-B type block copolymer (resin (A)) used in the present invention is explained in more detail.

The acidic group of the present invention includes $-PO_3H_2$, $-COOH$, $-SO_3H$, a phenolic hydroxy group,

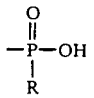

(R represents a hydrocarbon group or —OR′ (wherein R′ represents a hydrocarbon group)), and a cyclic acidic anhydride-containing group, and the preferred acidic groups are $-COOH$, $-SO_3H$, a phenolic hydroxy group, and

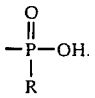

In the

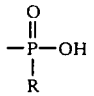

group contained in the resin (A) as an acidic group, R represents a hydrocarbon group or a —OR′ group (wherein R′ represents a hydrocarbon group), and, preferably, R and R′ each represents an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl groups) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl groups).

Examples of the phenolic hydroxy group described above are methacrylic acid esters and amides each having a hydroxyphenol group or a hydroxyphenyl group as a substituent.

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene- 1,2-dicarboxylic acid anhydride ring, and 2,3-bicyclo[2,2,-2]octanedicarboxylic acid anhydride. These rings may be substituted with, for example, a halogen atom (e.g., chlorine and bromine atoms) and an alkyl group (e.g., methyl, ethyl, butyl, and hexyl groups).

Specific examples of the aromatic dicarboxylic acid anhydrides include phthalic anhydride ring, naphtnalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine atoms), an alkyl group (e.g., methyl, ethyl, propyl, and butyl groups), a hydroxyl group, a cyano group, a nitro group, and an alkoxycarbonyl group (e.g., methoxycarbonyl and ethoxycarbonyl groups).

The above-described "polymer component having the specific acidic group" may be any vinyl compounds each having the acidic group and being capable of copolymerizing with a vinyl compound corresponding to a polymer component constituting other block component in the resin (A) used in the present invention, that is, the methacrylate component shown by the formula (I) described above, etc.

For example, such vinyl compounds are described in *Macromolecular Data Handbook (Foundation)*, edited by Kobunshi Gakkai, 1986. Specific examples of the vinyl compound are acrylic acid, α- and/or β-substituted acrylic acid (e.g., α-acetoxy compound, α-acetoxymethyl compound, α-(2-amino)methyl compound, α-chloro compound, α-bromo compound, α-fluoro compound, α-:ributylsyrlyl compound, α-cyano compound, β-chloro compound, β-bromo compound, α-chloro-β-methoxy compound, α,β-dichloro compound), methacrylic acid, itaconic acid, itaconic acid half esters, itaconic acid half amides, crotonic acid, 2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acidic group in the substituent thereof.

Specific examples of the compounds having a specific acidic group are illustrated below. In the following examples, a represents —H, $-CH_3$, —Cl, —Br, —CN, $-CH_2COOCH_3$, or $-CH_2COOH$; b represents —H or $-CH_3$, n represents an integer of from 2 to 18; m represents an integer of from 1 to 12; and l represents an integer of from 1 to 4.

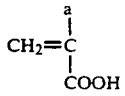

(a-1)

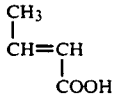

(a-2)

-continued
(a-3)
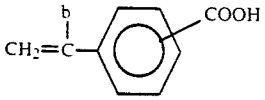
(a-4)
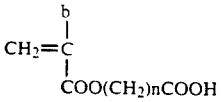
(a-5)
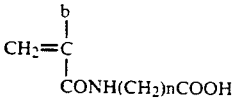
(a-6)
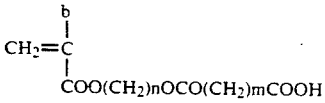
(a-7)
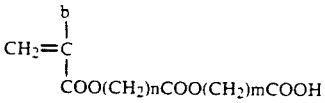
(a-8)
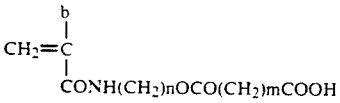
(a-9)
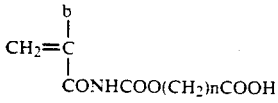
(a-10)
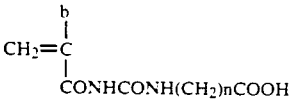
(a-11)
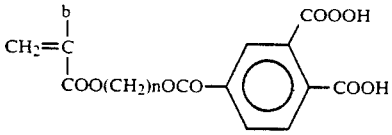
(a-12)
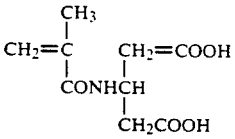
(a-13)
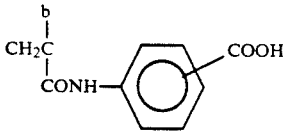
(a-14)
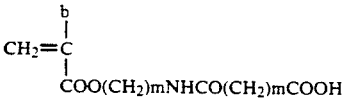
(m's may be the same or different)
$CH_2{=}CH{-}CH_2OCO(CH_2)_mCOOH$ (a-15)
$CH_2{=}CH{\leftarrow}CH_2{\rightarrow}_7COOH$ (a-16)
-continued
(a-17)
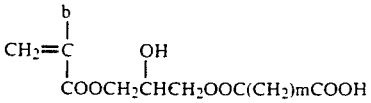
(a-18)
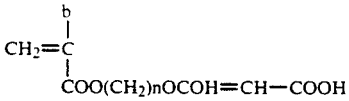
(a-19)
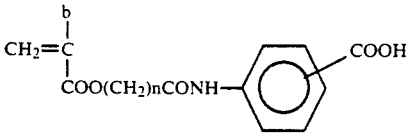
(a-20)
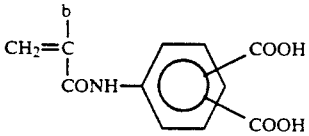
(a-21)
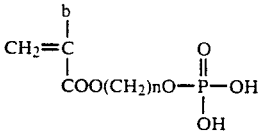
(a-22)
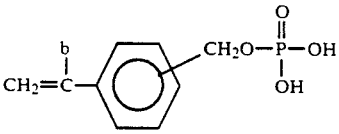
(a-23)
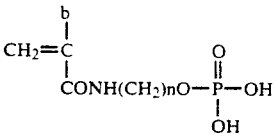
(a-24)
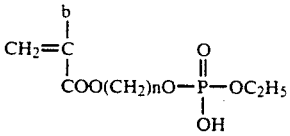
(a-25)
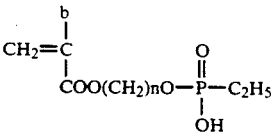
(a-26)
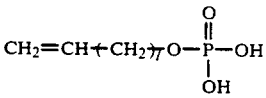
(a-27)
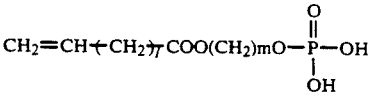
(a-28)
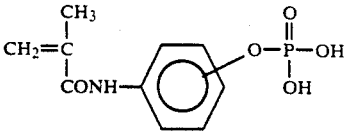

-continued (a-29)

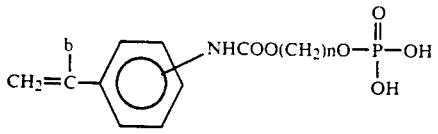

(a-30)

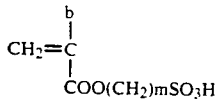

(a-31)

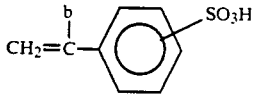

(a-32)

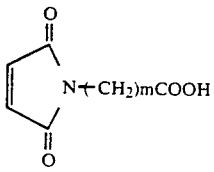

(a-33)

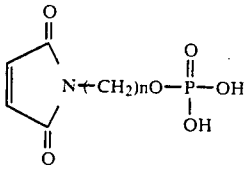

(a-34)

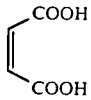

(a-35)

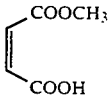

(a-36)

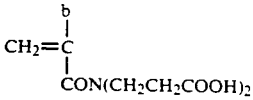

(a-37)

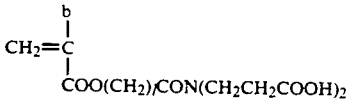

(a-38)

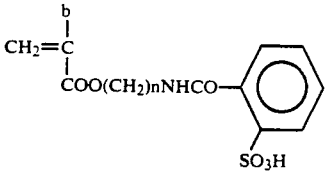

(a-39)

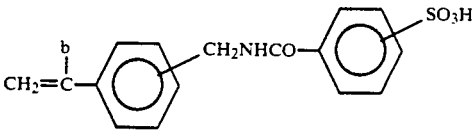

-continued (a-40)

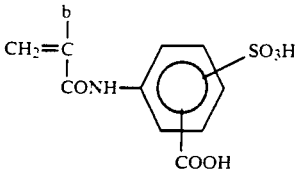

(a-41)

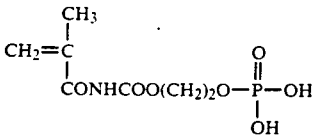

(a-42)

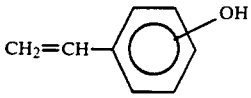

(a-43)

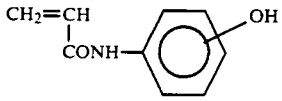

(a-44)

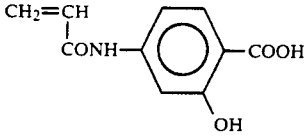

(a-45)

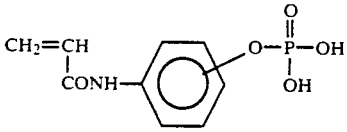

The A block of the AB block copolymer used in the present invention may contain two or more kinds of the polymer components each having the acidic group, and in this case, two or more kinds of these acidic group-containing components may be contained in the A block in the form of a random copolymer or a block copolymer.

Also, other components having no acidic group may be contained in the A block, and examples of such components include the components shown by the above formula (I) or the formula (II) shown below. The content of the component having no acidic group in the A block is preferably from 0 to 50% by weight, and more preferably from 0 to 20% by weight. It is most preferred that such a component is not contained in the A block.

Then, the polymer component constituting the B block in the AB type block copolymer (resin (A)) used in the present invention is explained in detail.

The B block contains at least a methacrylate component shown by the above-described formula (I) and the methacrylate component shown by the formula (I) is contained in the B block in an amount of preferably from 30 to 100% by weight, and more preferably from 50 to 100% by weight.

In the repeating unit shown by the formula (I), the hydrocarbon group represented by $R_1$ may be substituted.

In formula (I), $R_1$ is preferably a hydrocarbon group having from 1 to 18 carbon atoms, which may be substituted. The substituent for the hydrocarbon group may be any substituent other than the above-described acidic groups contained in the polymer component constituting the A block of the AB type block copolymer, and examples of such a substituent are a halogen atoms (e.g., fluorine, chlorine, and bromine) and —O—$Z_1$, —COO—$Z_1$, and —OCO—$Z_1$ (wherein $Z_1$ represents an aklyl group having from 1 to 22 carbon atoms, e.g., methyl, ethyl, propyl, butyl, hexyl, octyl, decyl, dodecyl, hexadecyl, and octadecyl). Preferred examples of the hydrocarbon group include an alkyl group having from 1 to 18 carbon atoms which may be substituted (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl groups), an alkenyl group having from 4 to 18 carbon atoms which may be substituted (e.g., 2-methyl-1-porpenyl, 2-butenyl, 2-pentenyl, 3-methyl-2-pentenyl, 1-pentenyl, 1-hexenyl, 2-hexenyl, and 4-methyl-2-hexcenyl groups), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl groups), an alicyclic group having from 5 to 8 carbon atoms which may be substituted (e.g., cyclohexyl, 2-cyclohexylethyl, and 2-cyclopentylethyl groups), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl groups).

In the hydrocarbon group represented by $R_1$, when $R_1$ is an aliphatic group, it is preferred that the component shown by formula (I) contains a component of formula (I) containing an aliphatic group of 1 to 5 carbon atoms in an amount of at least 60% by weight of the total components of formula (I).

Furthermore, it is preferred that in the resin (A), a part or all of the -repeating unit represented by formula (I) constituting the B block is the repeating unit shown by the following formula (Ia) and/or formula (Ib). Accordingly, it is preferred that at least one repeating unit shown by the following formula (Ia) or (Ib) is contained in the B block in an amount of at least 30% by weight, and preferably from 50 to 100% by weight.

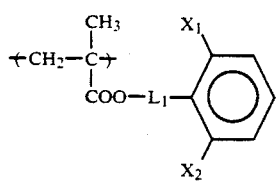
(Ia)

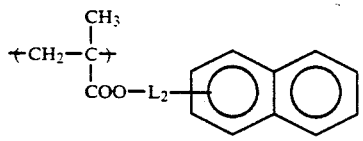
(Ib)

In the above formulae (Ia) and (Ib), $X_1$ and $X_2$ each, independently, represents a hydrogen atom, a hydrocarbon group having from 1 to 10 carbon atoms, a chlorine atom, a bromine atom, —$COZ_2$ or —$COOZ_2$ (wherein $Z_2$ represents a hydrocarbon group having from 1 to 10 carbon atoms) and $L_1$ and $L_2$ each represents a single bond or a linkage group having from 1 to 4 linking atoms, each bond bonding —COO— and the benzene ring.

By incorporating the repeating unit shown by the above formula (Ia) and/or (Ib) into the B block having no acidic group, more improved electrophotographic characteristics (in particular, $V_{10}$, D.R.R., $E_{1/10}$) can be attained. Although the reason therefor is not understood, it is considered that polymer molecular chains are suitably arranged in boundary surfaces between photoconductive particles (e.g., zinc oxide) in the light-sensitive layer by the effect of a planner benzene ring having a substituent at the orth-position or a naphthalene ring which is an ester moiety of the methacrylate.

In formula (Ia), $X_1$ and $X_2$ each preferably represents a hydrogen atom, a chlorine atom, a bromine atom, an alkyl group having up to 4 carbon atoms (e.g., methyl, ethyl, propyl, and butyl groups), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl groups), an aryl group (e.g., phenyl, tolyl, xylyl, bromophenyl, methoxyphenyl, chlorophenyl, and dichlorophenyl), or —$COZ_2$ or —$COOZ_2$, wherein $Z_2$ preferably represents any of the above-recited hydrocarbon groups.

In formula (Ia), $L_1$ is a bond or a linkage group containing 1 to 4 linking atoms which connects between —COO— and the benzene ring, e.g., $\text{-}(CH_2)_{n1}\text{-}$ (wherein n1 represents an integer of 1, 2 or 3, —$CH_2CH_2OCO$—, $\text{-}(CH_2O)_{n2}\text{-}$ wherein $n_2$ represents an integer of 1 or 2, and —$CH_2CH_2O$—.

In formula (Ib), $L_2$ has the same meaning as $L_1$.

Specific examples of repeating units represented by formula (Ia) or (Ib) which are preferably used in the present invention are shown below for illustrative purposes, but the present invention is not to be construed as being limited thereto.

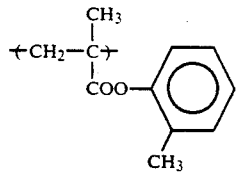
(b-1)

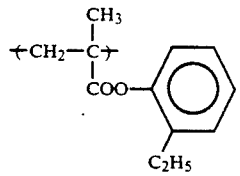
(b-2)

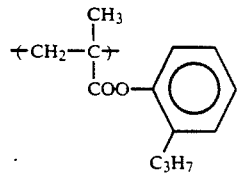
(b-3)

-continued
(b-4)
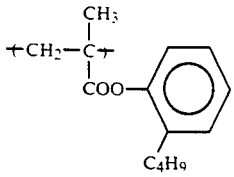
(b-5)
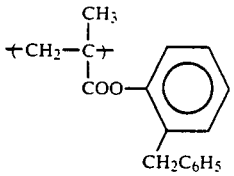
(b-6)
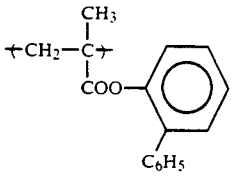
(b-7)
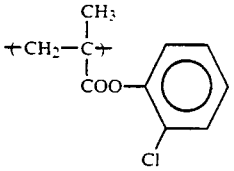
(b-8)
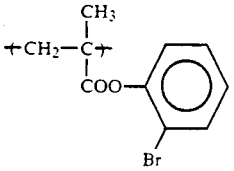
(b-9)
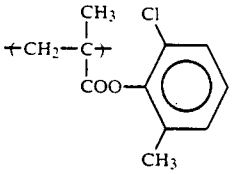
(b-10)
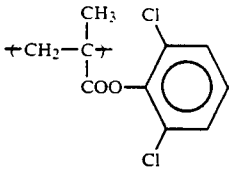
(b-11)
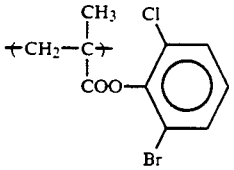
(b-12)
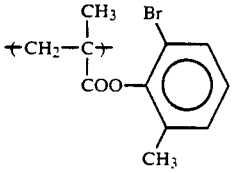
-continued
(b-13)
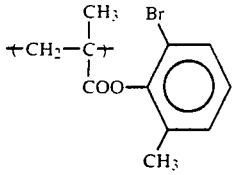
(b-14)
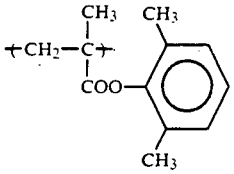
(b-15)
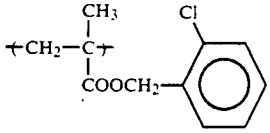
(b-16)
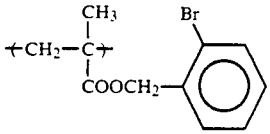
(b-17)
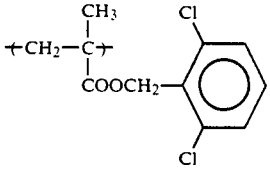
(b-18)
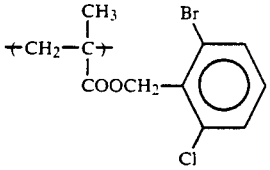
(b-19)
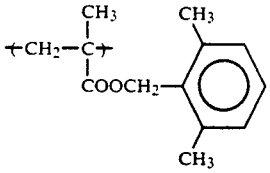
(b-20)
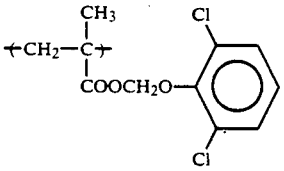
(b-21)
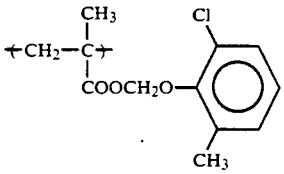

-continued
(b-22)
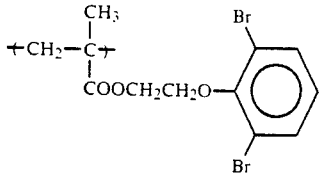
(b-23)
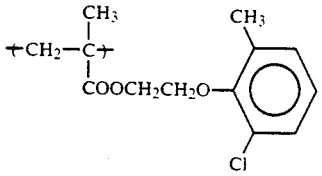
(b-24)
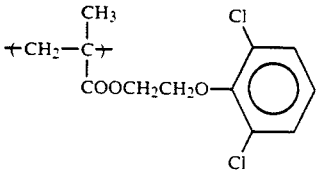
(b-25)
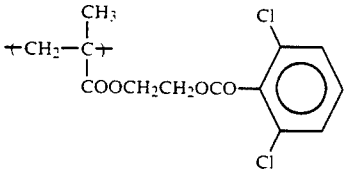
(b-26)
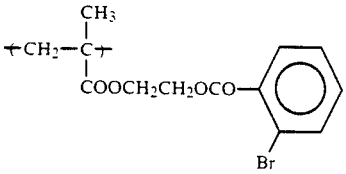
(b-27)
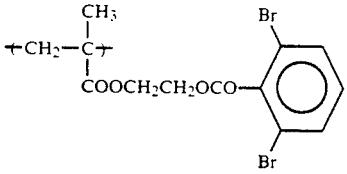
(b-28)
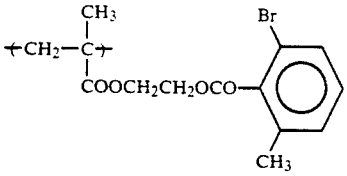
(b-29)
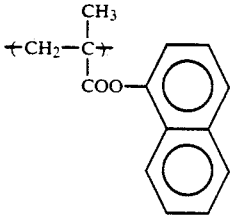
-continued
(b-30)
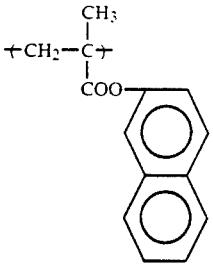
(b-31)
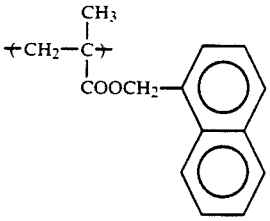
(b-32)
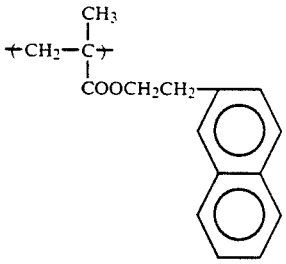
(b-33)
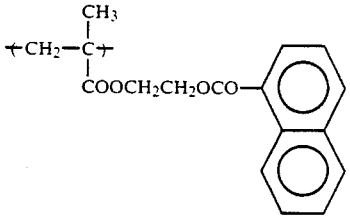
(b-34)
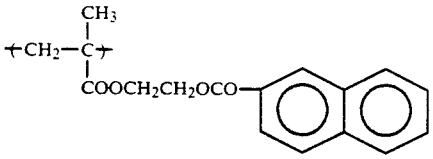
(b-35)
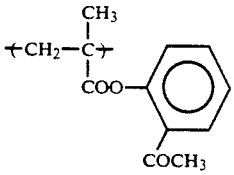
(b-36)
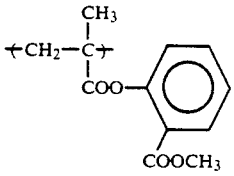

-continued (b-37)

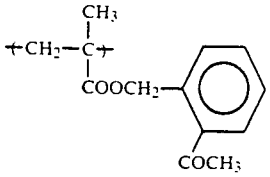

(b-38)

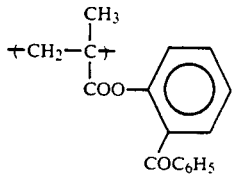

(b-39)

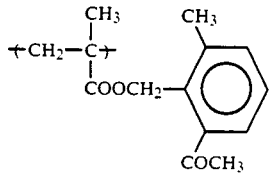

(b-40)

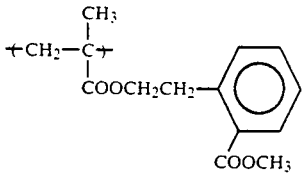

The block B which is constituted separately from the block A composed of the polymer component containing the above-described acidic group may contain two or more kinds of the repeating units shown by the above formula (I) (preferably, the group (Ia) or (Ib)) and may further contain polymer components other than the above repeating units. When the block B having no acidic group contains two or more kinds of the polymer components, the polymer components may be contained in the block B in the form of a random copolymer or a block copolymer, but are preferably randomly contained therein.

The polymer component other than the repeating units shown by the above formula (I), (Ia) and/or (Ib), which is contained in the block B together with the polymer component(s) selected from the repeating units of the formulae (I), (Ia) and (Ib), any components copolymerizable with the repeating units can be used.

Examples of such other components include the repeating unit represented by formula (II):

(II)

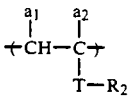

wherein T represents $$-COO-,\ -OCO-,\ +CH_2\rangle_{m1}-OCO-,\ +CH_2\rangle_{m2}-COO-,$$

$$-O-,\ -SO_2-,\ -\overset{R_3}{\overset{|}{C}}ON-,\ -SO_2\overset{R_3}{\overset{|}{N}}-,\ -CONHCOO-,$$

-continued $$-CONHCONH- \text{ or } -\underset{\underset{O}{\|}}{C}-$$

(wherein m1 and m2 each represents an integer of 1 or 2. $R_3$ represents the same group as $R_1$ in formula (I)); $R_2$ represents the same group as $R_1$ in formula (I); and $a_1$ and $a_2$, which may be the same or different, each represents a hydrogen atom, a halogen atom, a cyano group, a hydrocarbon group having from 1 to 8 carbon atoms, $-COO-Z_3$ or $-COO-Z_3$ bonded via a hydrocarbon group having from 1 to 8 carbon atoms wherein $Z_3$ represents a hydrocarbon group having from 1 to 18 carbon atoms. More preferably, $a_1$ and $a_2$, which may be the same or different, each represents a hydrogen atom, an alkyl group having from 1 to 3 carbon atoms, e.g., methyl, ethyl, and propyl groups). $-COO-Z_3$ or $-CH_2COO-Z_3$ (wherein $Z_3$ preferably represents an alkyl group having from 1 to 18 carbon atoms or an alkenyl group having from 3 to 18 carbon atoms, e.g., methyl, ethyl, propyl, butyl, hexyl, octyl, decyl, dodecyl, tridecyl, tetradecyl, hexadecyl, octadecyl, pentenyl, hexenyl, octenyl and decenyl groups, and these alkyl and alkenyl groups may have a substituent as described for the above $R_1$.

Further, other monomers which constitute repeating units other than the above repeating unit include, for example, styrenes (e.g., styrene, vinyltoluene, chlorostyrene, bromostyrene, dichlorostyrene, vinylphenol, methoxystyrene, chloromethylstyrene, methoxymethylstyrene, acetoxystyrene, methoxycarbonylstyrene, and methylcarbamoylstyrene), acrylonitrile, methacrylonitrile, acrolein, methacrolein, vinyl group-containing heterocyclic compounds (e.g., N-vinylpyrrolidone, vinylpyridine, vinylimidazole, and vinylthiophene), acrylamide, and methacrylamide, but the other copolymer components used in the present invention are not limited to these monomers.

Further, the resin (A) of the present invention preferably contains a functional group capable of curing the resin by the action of at least one of heat and light, i.e., a heat- and/or photo-curable functional group. That is, it is preferred that the resin (A) used in the present invention contains a copolymer component containing a heat- and/or photo-curable functional group in the block B, in addition- to the functional copolymer component for forming a crosslinked structure in the resin (A) and the copolymer component corresponding to formula (I) (including formulae (Ia) and (Ib)), in order to improve the film strength and thereby to increase the mechanical strength of the electrophotographic light-sensitive material.

The proportion of the above-described copolymer component containing a heat- and/or photo-curable functional group in the resin (A) of the present invention is preferably from 0.5 to 30% by weight, more preferably 1 to 20% by weight. When the proportion is less than 0.5% by weight, any appreciable effect on improvement in the film strength of the photoconductive layer is not obtained due to insufficient curing reaction. On the other hand, when the proportion exceeds 30% by weight, excellent electrophotographic properties are difficult to retain even by the resin (A) of the present invention and are decreased to the same degree as those obtained by conventional resin binders. Also, the offset master produced from the resin (A) containing more than 30% by weight of the heat- and/or photo-curable functional group suffers from increased background stains in the non-image area in prints.

Specific examples of photo-curable functional group are those used in conventional photosensitive resins known as photo-curable resins as described in Hideo Inui and Gentaro Nagamatsu, *Kankosei Kobunshi*, Kodansha (1977), Takahiro Tsunoda, *Shin-Kankosei Jushi*, Insatsu Gakkai Shuppanbu (1981), G. E. Green and B. P. Strak, *J. Macro. Sci. Reas. Macro. Chem.*, C 21(2), pp. 187-273(1981-1982), and C. G. Rattey, *Photo-polymerization of Surface Coatings*, A Wiley Interscience Pub. (1982).

The heat-curable functional group includes functional groups other than the above-specified acidic groups. Examples of the heat-curing functional groups are described, e.g., Tsuyoshi Endo, *Netsukokasei Kobunshi no Seimitsuka*, C.M.C. (1986), Yuji Harasaki, *Saishin Binder Gijutsu Binran*, Ch. II-I, Sogo Gijutsu Center (1985), Takayuki Ohtsu, *Acryl Jushi no Gosei Sekkei to Shin-Yoto*, Chubu Kei-ei Kaihatsu Center Shuppanbu (1985), and Eizo Ohmori, *Kinosei Acryl Jushi*, Techno System (1985).

Specific examples of curing functional groups are —OH, —SH, —$NH_2$ —$NHR_5$ (wherein $R_5$ represents a hydrocarbon group, such as an alkyl group having 1 to 10 carbon atoms which may be substituted (e.g., methyl, ethyl, propyl, butyl, hexyl, octyl, decyl, 2-chloroethyl, 2-methoxyethyl, and 2-cyanoethyl groups), a cycloalkyl group having from 4 to 8 carbon atoms which may be substituted (e.g., cycloheptyl and cyclohexyl groups), an aralkyl group having from 7 to 12 carbon atoms which may be substituted (e.g., benzyl, phenethyl, 3-phenylpropyl, chlorobenzyl, methylbenzyl, and methoxybenzyl groups) and an aryl group which may be substituted (e.g., phenyl, tolyl, xylyl, chlorophenyl, bromophenyl, methoxyphenyl, and naphthyl groups)),

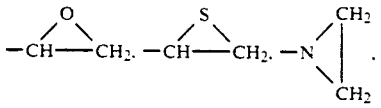

—$CONHCH_2OR_6$ (wherein $R_6$ represents a hydrogen atom or an alkyl group having from 1 to 8 carbon atoms (e.g., methyl, ethyl, propyl, butyl, hexyl, and octyl groups), —N=C=O, and a group containing polymerizable double bond

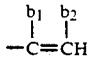

(wherein $b_1$ and $b_2$ each represents a hydrogen hydrogen atom, a halogen atom (e.g., chlorine and bromine atoms) or an alkyl group having from 1 to 4 carbon atoms (e.g., methyl and ethyl groups)). Also, specific examples of the above-described groups containing a polymerizable double bond include polymerizable groups having a lower polymerization reactivity than that of the monomer corresponding to the repeating unit of formula (I), for example,

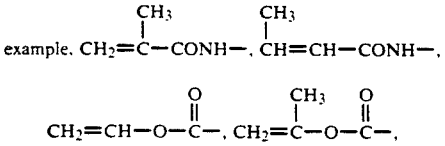

-continued

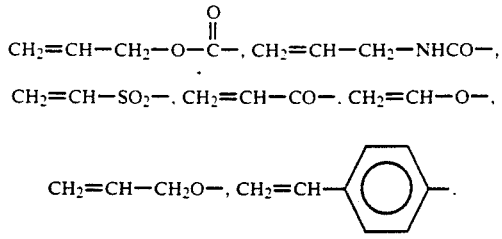

Examples of the repeating unit containing a heat- and/or photo-curable functional group are shown below. In the examples, b and c each represents -H or —$CH_3$, $R_{11}$ represents —CH=$CH_2$ or —$CH_2CH$=$CH_2$, $R_{12}$ represents

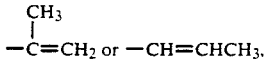

$R_{13}$ represents —$CH_2CH$=$CH_2$ or

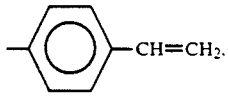

$R_{14}$ represents —CH=$CH_2$

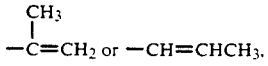

$R_{15}$ represents —CH=$CH_2$,

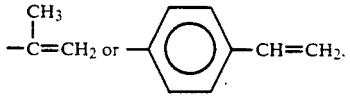

$R_{16}$ represents an alkyl group having 1 to 4 carbon atoms, $Q_1$ represents —S— or —O—, and $Q_2$ represents —OH or —$NH_2$, p and q each represents an integer of from 1 to 11, r represents an integer of from 1 to 10, s represents an integer of 2 to 11, and l is as defined above.

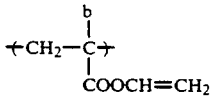

c-1)

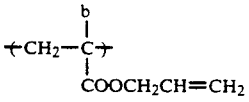

c-2)

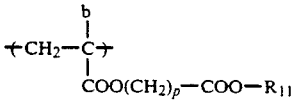

c-3)

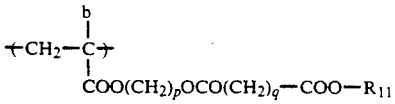

c-4)

-continued c-5)

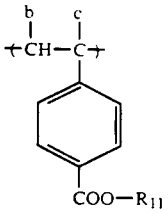

c-6

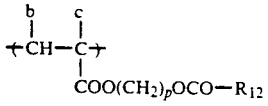

c-7

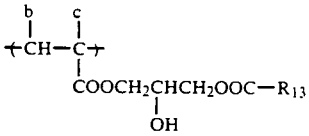

c-8)

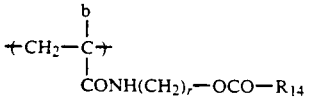

c-9)

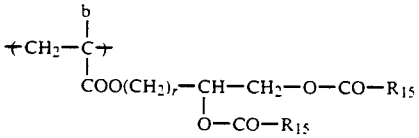

($R_{15}$'s may be the same or different)

c-10)

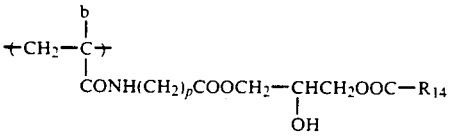

c-11)

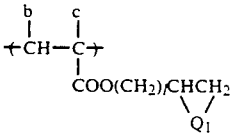

c-12)

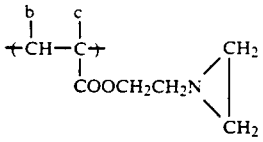

c-13)

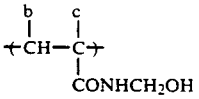

c-14)

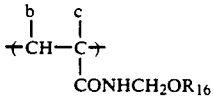

c-15)

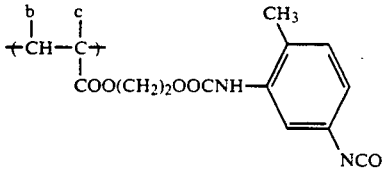

-continued c-16)

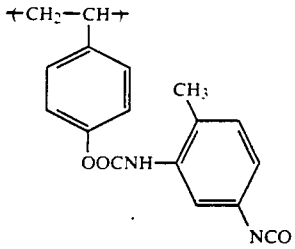

c-17)

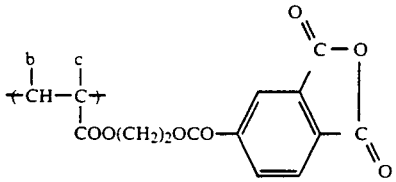

c-18)

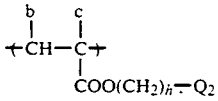

c-19)

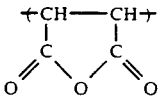

c-20)

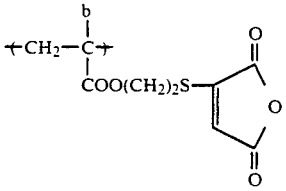

c-21)

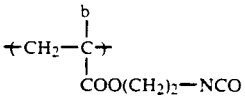

c-22)

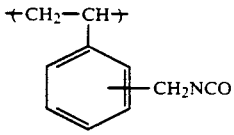

The AB type block copolymer (resin (A)) used in the present invention can be produced by a conventionally known polymerization reaction method. More specifically, it can be produced by the method comprising previously protecting the acidic group of a monomer corresponding to the polymer component having the specific acidic group to form a functional group, synthesizing an AB type block copolymer by an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a so-called known living polymerization reaction such as a group transfer polymerization reaction, etc., and then conducting a protection-removing reaction of the functional group formed by protecting the acid group by a hydrolysis reaction, hydrogenolysis reaction, an oxidative decomposition reaction, or a photodecomposition reaction to form the acidic group.

One of the examples is shown by the following reaction scheme (1):

Reaction Scheme (1)

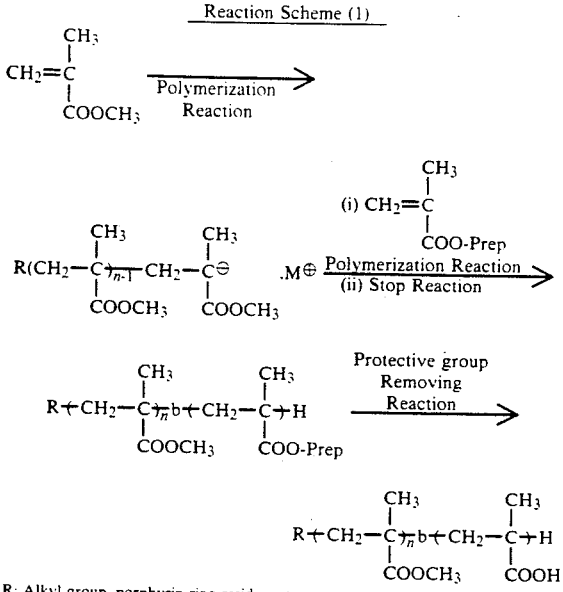

R: Alkyl group, porphyrin ring residue, etc.
Prep: Protective group (e.g., $-C(C_6H_5)_3$, $-Si(C_3H_7)_3$, etc.)
b: Block bond The above-described compounds can be easily synthesized according to the synthesis methods described, e.g., in P. Lutz, P. Masson et al, *Polym. Bull.* 12, 79 (1984), B. C. Anderson, G. D. Andrews, et al, *Macromolecules,* 14, 1601 (1981), K. Hatada, K. Ute, et al, *Polym. J.,* 17, 977 (1985), ihid., 18, 1037 (1987), Toshinobu Higashimura and Mitsuo Sawamoto, *Kobunshi Ronbun Shu (Polymer Treatieses,* 46, 189 (1989), M. Kuroki and T. Aida, *J. Am. Chem. Soc.,* 109, 4737 (1989), Teizo Aida and Shohei Inoue, Yuki Gosei Kagaku *(Organic Synthesis Chemistry),* 43, 300 (1985), and D. Y. Sogah, W. R. Hertler et al, *Macromolecules,* 20, 1473 (1987).

Furthermore, the AB block copolymer (resin (A)) can be also synthesized by a photoiniferter polymerization method using the monomer having the unprotected acidic group and also using a dithiocarbamate compound as an initiator. For example, the block copolymers can be synthesized according to the synthesis methods described in Takayuki Otsu, *Kobunshi (Polymer),* 37, 248 (1988), Shunichi Himori and Ryuichi Ohtsu, *Polym. Rep. Jap* 37, 3508 (1988), JP-A-64-111, and JP-A-64-26619.

Also, the protection of the specific acidic group of the present invention and the release of the protective group (a reaction for removing a protective group) can be easily conducted by utilizing conventionally known knowledges, such as the methods described, e.g., in Yoshio Iwakura and Keisuke Kurita, *Hannosei Kobunshi (Reactive Polymer),* published by Kodansha (1977), T. W. Greene, *Protective Groups in Organic Synthesis,* published by John Wiley & Sons (1981), and J. F. W. McOmie, *Protective Groups in Organic Chemistry,* Plenum Press, (1973).

In the AB type block copolymer (resin (A)), the content of the polymer component having the specific acidic group is from 0.5 to 20% by weight and preferably from 3 to 15% by weight per 100 parts by weight of the resin (A). The weight average molecular weight of the resin (A) is preferably from $3\times10^3$ to $1\times10^4$.

Then, the heat- and/or photo-curable resin (B) which can be used together with the resin (A) in the present invention is described hereinafter in detail.

The resin (B) is a heat- and/or photo-curable resin having a crosslinking functional group, i.e., a functional group of forming a crosslinkage between polymers by causing a crosslinking reaction by the action of at least one of heat and light, and, preferably, a resin which is capable of forming a crosslinked structure by reacting with the above-described functional group which can be contained in the resin (A).

That is, a reaction which causes bonding of molecules by a condensation reaction, an addition reaction, etc., or crosslinking by a polymerization reaction by the action of heat and/or light is utilized.

The heat-curable functional group include, practically, a group composed of at least one combination of a functional group having a dissociating hydrogen atom (e.g., —OH group, —SH group, and $-NHR_{31}$ group (wherein $R_{31}$ represents a hydrogen atom, an aliphatic group having from 1 to 12 carbon atoms, which may be substituted, or an aryl group which may be substituted) and a functional group selected from

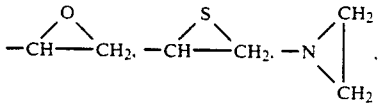

—NCO, —NCS, and a cyclic dicarboxylic acid anhydride; $-CONHCH_2OR_{32}$ (wherein $R_{32}$ represents a hydrogen atom or an alkyl group having from 1 to 6 carbon atoms (e.g., methyl, ethyl, propyl, butyl, and hexyl groups)); and a polymerizable double bond group.

The functional group having a dissociating hydrogen atom include, preferably, —OH group, —SH group, and $-NHR_{31}$ group.

Specific examples of the above polymerizable double bond group and the photo-curable functional group are those of the groups described as "heat- and/or photo-curable functional group" contained in the above-described resin (A).

Polymers and copolymers each having the aforesaid functional group are illustrated as examples of the resin (B) of the present invention.

Practical examples of such polymers or copolymers are described in Tsuyoshi Endo, *Netsukokasei Kobunshi no Seimitsuka (Precising of Thermo-setting Macromolecule,* published by C.M.C., 1986, Yuji Harasaki, *Newest Binder Technology Handbook,* Chapter II-1, published by Sogo Gijutsu Center, 1985, Takayuki Ohtsu, *Synthesis, Planning, and New Use Development of Acryl Resins,* published by Chubu Keiei Kaihatsu Center Shuppan Bu, 1985, and Eizo Ohmori, *Functional Acrylic Resins,* published by Techno System. Specific examples thereof include polyester resins, unmodified epoxy resins, polycarbonate resins, vinyl alkanoate resins, modified polyamide resins, phenol resins, modified alkyd resins, melamine resins, acryl resins and styrene resin, and these resins may have the aforesaid functional group capable of causing a crosslinking reaction in the molecule. It is preferred that these resins do not have the acidic group contained in the resin (A) or have not been modified.

Specific examples of the monomer corresponding to the copolymer component having the functional group are vinylic compounds having the functional group.

Examples thereof are described in *Macromolecular Data Handbook (foundation)*, edited by Kobunshi Gakkai, published by Baifukan, 1986. Specific examples thereof are acrylic acid, α- and/or β-substituted acrylic acids (e.g., α-acetoxy compound, α-acetoxymethyl compound, α-(2-aminomethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and .vinyl compounds having the aforesaid functional group in the substituent of the ester derivatives or amide derivatives of these carboxylic acids or sulfonic acids, or in the substituent of styrene derivatives.

More practically, a specific example of the resin (B) is a (meth)acrylic compolymer containing a monomer represented by the above-described formula (II) as a copolymer component in an amount of at least 30% by weight.

The content of "the copolymer component having the crosslinkable (crosslinking) functional group" in the resin (B) is preferably from 0.5 to 30 mole %.

The weight average molecular weight of the resin (B) is preferably from $1\times10^3$ to $1\times10^5$, and more preferably from $5\times10^3$ to $5\times10^4$.

The compounding ratio of the resin (A) and the resin (B) varies depending upon the kind and particle sizes of the inorganic photoconductive substance used and the surface state of the desired photoconductive layer, but the ratio of the resin (A) to the resin (B) can be from 5 to 80:95 to 20 by weight ratio, and preferably from 10 to 50:90 to 50 by weight.

On the other hand, in the present invention, a crosslinking agent can be used together with the resin (A). In the case of using a crosslinking agent, it is preferred that the resin (A) has a heat- and/or photocurable functional group and/or is used together with the resin (B). By using a crosslinking agent, crosslinking in the film or layer can be accelerated. The crosslinking agent which can be used in the present invention include the compounds which are usually used as crosslinking agents. Practical compounds are described in Shinzo Yamashita & Tosuke Kaneko, *Crosslinking Agent Handbook*, published by Taisei Sha, 1981, and *Macromolecular Data Handbook (Foundation)*, edited by Kobunshi Gakkai, published by Baifukan, 1986.

Specific examples thereof are organic silane series compounds (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, o-toluylene diisocyanate, diphenylmethane diisocyanate, triphenylmethane triisocyanate, polyethylenepolyphenyl isocyanate, hexamethylene diisocyanate, isohorone diisocyanate, and macromolecular polyisocyanate), polyol series compounds (e.g., 1,4-butanediol, polyoxypropylene glycol, polyoxyalkylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described in Hiroshi Kakiuchi, *New Epoxy Resin* published by Shokodo, 1985 and Kuniyuki Hashimoto, *Epoxy Resins*, published by Nikkan Kogyo Shinbun Sha, 1969), melamine resins (e.g.,. the compounds described in Ichiro Miwa and Hideo Matsunaga, *Urea melamine Resins*, published by Nikkan Kogyo Shinbun Sha, 1969), and poly(meth)acrylate series compounds (e.g., the compounds described in Shin Ohgawara, Takeo Saegusa, and Toshinobu Higashimura, *Oligomer*, published by Kodansha, 1976, and Eizo Ohmori, *Functional Acrylic Resins*, published by Techno System, 1985. Specific examples include polyethylene glycol diacrylate, neopentyl glycol diacrylate, 1,6-hexanediol acrylate, trimethylolpropane triacrylate, pentaerythritol polyacrylate, bisphenol A-diglycidyl ether diacrylate, oligoester acrylate, and their corresponding methacrylates).

The amount of the crosslinking agent used in the present invention is from 0.5 to 30% by weight, and preferably from 1 to 10% by weight, based on the amount of the resin binder.

In the present invent-ion, the binder resin may, if necessary, contain a reaction accelerator for accelerating the crosslinking reaction of the photoconductive layer.

When the crosslinking reaction is of a reaction type for forming a chemical bond between the functional groups, organic acids (e.g., acetic acid, propionic acid, butyric acid, benzenesulfonic acid, and p-toluenesulfonic acid) can be used.

When the crosslinking reaction is of a polymerization reaction type, polymerization initiators (e.g., peroxides and azobis series compounds, preferably azobis series polymerization initiators) or monomers having a polyfunctional polymerizable group (e.g., vinyl methacrylate, allyl methacrylate, ethylene glycol diacrylate, divinylsuccinic acid esters, divinyladipic acid esters, diallylsuccinic acid esters, 2-methylvinyl methacrylate, and divinylbenzene) can be used.

Furthermore, in the present invention, other resin(s) can be used in addition to the resin(s) of the present invention. Examples of such resins are alkyd resins, polybutyral resins, polyolefins, ethylene-vinyl acetate copolymers, styrene resins, styrene-butadiene resins, acrylate-butadiene resins, and vinyl alkanoate resins.

The content of aforesaid other resin should not exceed 30% by weight of the total resins for the binder resins and, if the content is 30% by weight or more, the effect of this invention (in particular, the improvement of electrostatic characteristics) cannot be obtained.

The coating composition containing the binder resin in the present invention for forming a photoconductive layer is crosslinked or subjected to thermosetting after coating. For performing crosslinking or thermosetting, a severer drying condition than that used for producing conventional electrophotographic light-sensitive materials is employed. For example, the drying step is carried out at a higher temperature and/or for a longer time. Also, after evaporating off the solvent in the coating composition by drying, the photoconductive layer may be further subjected to a heat treatment, for example, at from 60° to 120° C. for from 5 to 120 minutes. In the case of using the aforesaid reaction accelerator, a milder drying condition can be employed.

In the present invention, when the binder resin contains the above-described resin (A) and at least one of the high molecular weight resins (C), (D), and (E) (a weight average molecular weight of from $5\times10^4$ to $5\times10^5$) described above, the mechanical strength of the electrophotographic light-sensitive material is further improved.

The use of the resin (C), (D), or (E) sufficiently increases the mechanical strength of the photoconductive layer when the mechanical strength of the photoconductive layer is insufficient by the use of the resin (A) only.

Also, in the electrophotographic light-sensitive material of the present invention using the low molecular weight resin (A) and one of the high molecular weight resins (C) to (E) together, the smoothness of the surface of the photoconductive layer is good in the case of using as an electrophotographic lithographic printing master plate. Also, since zinc oxide particles as a photoconductive substance are sufficiently dispersed in the binder resin, when the photoconductive layer is subjected to a desensitizing treatment with a desensitizing solution after imagewise exposure and processing, the non-image portions are sufficiently and uniformly rendered hydrophilic and adhesion of a printing ink to the non-image portions at printing is inhibited, whereby no background staining occurs even by printing 10,000 prints.

That is, in the present invention, when the resin (A) and one of the resins (C) to (E) are used together, the binder resin is suitably adsorbed onto inorganic photoconductive substance and suitably coats the particles, whereby the film strength of the photoconductive layer is sufficiently maintained.

Then, the use of a combination of the low molecular weight resin (A) and the high molecular weight resin (C) having neither acidic group nor basic group contained in the binder resin (A) of the present invention is described in detail.

The resin (C) which can be used in the present invention is the resin having a weight average molecular weight of from $5\times10^4$ to $5\times10^5$ and having neither the above-described acidic group nor a basic group. The weight average molecular weight thereof is preferably from $8\times10^4$ to $3\times10^5$.

The glass transition point of the resin (C) is preferably in the range of from 0° C. to 120° C., and more preferably from 10° C. to 80° C.

Any resins (C) which are conventionally used as a binder resin for electrophotographic light-sensitive materials can be used in the present invention alone or as a combination thereof. Examples of these materials are described in Harumi Miyahara and Hidehiko Takei, *Imaging*, Nos. 8 and 9 to 12, 1978 and Ryuji Kurita and Jiro Ishiwata, *Kobunshi (Macromolecule)*, 17, 278–284 (1958).

Specific examples thereof include an olefin polymer and copolymer, a vinyl chloride copolymer, a vinylidene chloride copolymer, a vinyl alkanoate polymer, a vinyl alkanoate copolymer, an allyl alkanoate polymer, an allyl alkanoate copolymer, styrene, a styrene derivative, a styrene polymer, a styrene copolymer, a butadiene-styrene copolymer, an isoprene-styrene copolymer, a butadiene-unsaturated carboxylic acid ester copolymer, an acrylonitrile copolymer, a methacrylonitrile copolymer, an alkyl vinyl ether copolymer, an acrylic acid ester polymer and copolymer, a methacrylic acid ester polymer and copolymer, a styrene-acrylic acid ester copolymer, a styrene-methacrylic acid ester copolymer, itaconic acid diester polymer and copolymer, a maleic anhydride copolymer, an acrylamide copolymer, a methacrylamide copolymer, a hydroxy group-modified silicone resin, a polycarbonate resin, a ketone resin, an amide resin, a hydroxy group- and carboxy group-modified polyester resin, a butyral resin, a polyvinyl acetal resin, a cyclized rubber-methacrylic acid ester copolymer, a cyclized rubber-acrylic acid ester copolymer, a copolymer having a heterocyclic group containing no nitrogen atom (examples of the heterocyclic ring are a furan ring, a tetrahydrofuran ring, a thiophene ring, a dioxane ring, a dioxolan ring, a lactone ring, a benzofuran ring, a benzothiophene ring, and a 1,3-dioxetane ring), and an epoxy resin.

More specifically, examples of the resin (C) include (meth)acrylic copolymers or polymers each containing at least one monomer shown by the following formula (III) as a (co)polymer component in a total amount of at least 30% by weight;

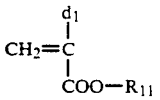

(III)

wherein $d_1$ represents a hydrogen atom, a halogen atom (e.g., chlorine and bromine atoms), a cyano group, or an alkyl group having from 1 to 4 carbon atoms, and is preferably an alkyl group having from 1 to 4 carbon atoms and $R_{11}$ represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-methoxyethyl, and 2-ethoxyethyl groups), an alkenyl group having from 2 to 18 carbon atoms, which may be substituted (e.g., vinyl, allyl, isopropenyl, butenyl, hexenyl, heptenyl, and octenyl groups), an aralkyl group having from 7 to 14 carbon atoms which may be substituted (e.g., benzyl, phenethyl, methoxybenzyl, ethoxybenzyl, and methylbenzyl groups), a cycloalkyl group having from 5 to 8 carbon atoms which may be substituted (e.g., cyclopentyl, cyclohexyl, and cycloheptyl groups), or an aryl group (e.g., phenyl, tolyl, xylyl, mesityl, naphthyl, methoxyphenyl, ethoxyphenyl, chlorophenyl, and dichlorophenyl groups). $R_1$: represents preferably an alkyl group having from 1 to 4 carbon atoms, an aralkyl group having from 7 to 14 carbon atoms which may be substituted (particularly preferred aralkyl includes benzyl, phenethyl, naphthylmethyl, and 2-naphthylethyl, which may be substituted), or a phenethyl group or a naphthyl group which may be substituted (examples of the substituent are chlorine and bromine atoms, methyl, ethyl, propyl, acetyl, methoxycarbonyl, and ethoxycarbonyl groups, and 2 or 3 substituents may be substituted).

Furthermore, in the resin (C), a component which is copolymerized with the above-described (meth)acrylic acid ester may be a monomer other than the monomer shown by formula (III), for example, α-olefins, alkanoic acid vinyl esters, alkanoic acid allyl esters, acrylonitrile, methacrylonitrile, vinyl ethers, acrylamides, methacrylamides, styrenes, and heterocyclic vinyls (e.g., 5- to 7-membered heterocyclic rings having from 1 to 3 nonmetallic atoms other than nitrogen atom (e.g., an oxygen atom and a sulfur atom), and specific compounds include vinylthiophene, vinyldioxane, and vinylfuran). Preferred examples of the monomer are alkanoic acid vinyl esters or alkanoic acid allyl esters each having from 1 to 3 carbon atoms, acrylonitrile, methacrylonitrile and styrene derivatives (e.g., vinyltoluene, butylstyrene, methoxystyrene, chlorostyrene, dichlorostyrene, bromostyrene, and ethoxystyrene).

On the other hand, the resin (C) used in the present invention does not contain a basic group, and examples of such basic groups include an amino group and a nitrogen atom-containing heterocyclic group, which may have a substituent.

Then, the use of a combination of the above-described low molecular weight resin (A) and the high molecular weight resin (D) containing at least one of —OH and a basic group used in the binder resin of the present invention is described hereinafter in detail.

In the resin (D), the proportion of the copolymer component containing a —OH group and/or a basic group is from 0.05 to 15% by weight, and preferably from 0.5 to 10% by weight of the resin (D). The weight average molecular weight of the resin (D) is from $5\times10^4$ to $5\times10^5$, and preferably from $8\times10^4$ to $1\times10^5$. The glass transition point of the resin (D) is preferably in the range of from 0° C. to 120° C., and more preferably from 10° C. to 80° C.

In the present invention, it is considered that the —OH group-containing component or the basic group-containing component in the resin (D) has a weak interaction with the interface with the photoconductive particles and the resin (A) to stabilize the dispersion of the photoconductive substance and improve the film strength of the photoconductive layer after being formed. However, if the content of these components in the resin (D) exceeds 15% by weight, the photoconductive layer formed tends to be influenced by moisture, and thus the moisture resistance of the photoconductive layer tends to decrease.

As "the copolymer component containing a —OH group and/or a basic group" contained in the resin (D), any vinylic compounds each having the substituent (i.e., the —OH group and/or the basic group) copolymerizable with the monomer shown by the above formula (III) can be used. Examples of the OH group-containing compounds similar to those described for the resin (A) above as well as vinyl group- or allyl group-containing alcohols, such as compounds containing a hydroxyl group in an ester substituent or an N-substituent, for example, allyl alcohol, methacrylic acid esters, and acrylamide.

The above basic group in the resin (D) includes, for example, an amino group represented by the following formula (IV) and a nitrogen-containing heterocyclic group.

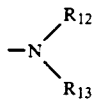

(IV)

wherein $R_{12}$ and $R_{13}$, which may be the same or different each represents a hydrogen atom, an alkyl group which may be substituted (e.g., methyl, ethyl, propyl, butyl, hexyl, octyl, decyl, dodecyl, tertadecyl, octadecyl, 2-bromoethyl, 2-chloroethyl, 2-hydroxyethyl, 2-cyanoethyl, 2-methoxyethyl and 3-ethoxypropyl groups), an alkenyl group which may be substituted (e.g., allyl, isopropenyl and 4-butynyl groups), an aralkyl group which may be substituted (e.g., benzyl, phenethyl, chlorobenzyl, methylbenzyl, methoxybenzyl, and hydroxybenzyl groups), an alicyclic group (e.g., cyclopentyl and cyclohexyl groups), or an aryl group (e.g., phenyl, tolyl, xylyl, mesityl, butylphenyl, methoxyphenyl, and chlorophenyl groups). Furthermore, $R_{12}$ and $R_{13}$ may be bonded by a hydrocarbon group through, if desired, a hetero atom.

The nitrogen-containing heterocyclic ring includes, for example, 5- to 7-membered heterocyclic rings each containing from 1 to 3 nitrogen atoms, and further the heterocyclic ring may form a condensed ring with a benzene ring, a naphthalene ring, etc. Furthermore, these heterocyclic rings may have a substituent. Specific examples of the heterocyclic ring are a pyrrole ring, an imidazole ring, a pyrazole ring, a pyridine ring, a piperazine ring, a pyrimidine ring, a pyridazine ring, an indolizine ring, an indole ring, a 2H-pyrrole ring, a 3H-indole ring, an indazole ring, a purine ring, a morpholine ring, an isoquinoline ring, a phthalazine ring, a naphthyridine ring, a quinoxaline ring, an acridine, a phenanthridine ring, a phenazine ring, a pyrrolidine ring, a pyrroline ring, an imidazolidine ring, an imidazoline ring, a pyrazolidine ring, a pyrazoline ring, piperidine ring, a piperazine ring, a quinacridine ring, an indoline ring, a 3,3-dimethylindolenine ring, a 3,3-dimethylnaphthindolenine ring, a thiazole ring, a benzothiazole ring, a naphthothiazole ring, an oxazole ring, a benzoxazole ring, a naphthoxazole ring, a selenazole ring, a benzoselenazole ring, a naphthoselenazole ring, an oxazoline ring, an isooxazoline ring, a benzoxazole ring, a morpholine ring, a pyrrolidone ring, a triazole ring, a benzotriazole ring, and a triazine ring.

The desired monomer is obtained by incorporating —OH and/or the basic group into the substituent of an ester derivative or amide derivative derived from a carboxylic acid or a sulfonic acid having a vinyl group as described in *Kobunshi (Macromolecular) Data Handbook (Foundation)*, edited by Kobunshi Gakkai, published by Baifukan, 1986. Examples of such a monomer are 2-hydroxyethyl methacrylate, 3-hydroxypropyl methacrylate, 3-hydroxy-2-chloromethacrylate, 4-hydroxybutyl methacrylate, 6-hydroxyhexyl methacrylate, 10-hydroxydecyl methacrylate, N-(2-hydroxyethyl)acrylamide, N-(3-hydroxypropyl)methacrylamide, N-(α,α-dihydroxymethyl)ethylmethacrylamide, N-(4-hydroxybutyl)methacrylamide, N,N-dimethylaminoethyl methacrylate, 2-(N,N-diethylaminoethyl)methacrylate, 3-(N,N-dimethylpropyl)methacrylate, 2-(N,N-dimethylethyl)methacrylamide, hydroxystyrene, hydroxymethylstyrene, N,N-dimethylaminomethylstyrene, N,N-diethylaminomethylstyrene, N-butyl-N-methylaminomethylstyrene, and N-(hydroxyphenyl)-methacrylamide. Examples of the vinyl compound having a nitrogen-containing heterocyclic ring are described in the aforesaid *Macromolecular Data Handbook (Foundation)*, pages 175 to 181, D. A. Tomalia, Reactive Heterocyclic *Monomers*, Chapter 1 of Functional Monomers, Vol. 2, Marcel DeRRer Inc., N.Y. (1974), and L. S. LusRin, *Basic Monomers*, Chapter 3 of *Functional Monomers, Vol.* 2, Marcel DeRRer Inc., N.Y. (1974).

As the resin (D), any conventional known resins can be used in this invention as long as they have the above-described properties and, for example, the conventionally known resins described above for the resin (C) can be used.

More specifically, examples of the resin (D) are (meth)acrylic copolymers each containing the above-described monomer shown by formula (III) described above as the copolymer component which is copolymerizable with a component containing the —OH group and/or the basic group in a proportion of at least 30% by weight of the copolymer.

Furthermore, the resin (D) may contain monomers other than the above-described monomer containing the —OH group and/or the basic group in addition to the latter monomer as a copolymer component. Examples of such a monomer are those described above for the monomers which can be used as other copolymer components for the resin (C).

Then, the use of a combination of the aforesaid low molecular weight resin (A) and the high molecular weight resin (E) having an acidic group as the side chain of the copolymer component at a content of less than 50%, and preferably less than 30% of the content of the acidic group contained in the resin (A) or an acidic group having a pKa value larger than that of the acidic group contained in the resin (A) as the side chain of the copolymer component is described in detail.

The weight average molecular weight of the resin (E) is from $5\times10^4$ to $5\times10^5$, and preferably from $7\times10^4$ to $4\times10^5$.

The acidic group contained at the side chain of the copolymer in the resin (E) is preferably contained in the resin (E) at a proportion of from 0.05 to 3% by weight and more preferably from 0.1 to 1.5% by weight. Also, it is preferred that the acidic group is incorporated into the resin (E) in a combination shown in Table A below.

TABLE A

| Acidic Group in Resin (AL) | Acidic Group in Resin (E) |
|---|---|
| $-SO_3H$ and/or $-PO_3H_2$ | $-COOH$ |
| $-SO_3H$, $-PO_3H_2$ and/or $-COOH$ | $-\overset{\overset{O}{\|}}{\underset{\underset{OH}{\|}}{P}}-R$ |

The glass transition point of the resin (E) is preferably in the range of from 0° C. to 120° C., more preferably from 0° C. to 100° C., and most preferably from 10° C. to 80° C.

The resin (E) shows a very weak interaction for photoconductive particles as compared to the resin (A), has a function of mildly coating the particles, and sufficiently increases the mechanical strength of the photoconductive layer, without reducing the function of the resin (A), when the strength thereof is insufficient by the resin (A) alone.

If the content of the acidic group in the side chain of the resin (E) exceeds 3% by weight, the adsorption of the resin (E) onto photoconductive particles occurs to destroy the dispersion of the photoconductive particles and to form aggregates or precipitates, which results in causing a state of not forming coated layer or greatly reducing the electrostatic characteristics of the photoconductive particles even if the coated layer is formed. Also, in such a case, the surface property of the photoconductive layer is roughened to reduce the strength to mechanical friction.

In the $$-\overset{\overset{O}{\|}}{\underset{\underset{OH}{\|}}{P}}-R_0$$

group of the resin (E), $R_o$ represents a hydrocarbon group or $-OR_o'$ wherein $R_o'$ represents a hydrocarbon group. Specific examples of $R_o$ and $R_o'$ include an alkyl group having from 1 to 12 carbon atoms which may be substituted (e.g., methyl, ethyl, propyl, butyl, hexyl, octyl, decyl, dodecyl, 2-chloroethyl, 2-methoxyethyl, 2-ethoxyethyl, and 3-methoxypropyl groups), an aralkyl group having from 7 to 12 carbon atoms which may be substituted (e.g., benzyl, phenethyl, chlorobenzyl, methoxybenzyl, and methylbenzyl groups), an alicyclic group having from 5 to 8 carbon atoms which may be substituted (e.g., cyclopentyl and cyclohexyl groups), and an aryl group which may be substituted (e.g., phenyl, tolyl, xylyl, mesityl, naphthyl, chlorophenyl, and methoxyphenyl groups).

The copolymer component having the acidic group in the resin (E) used in the present invention include, for example, components similar to those described for the polymer components containing specific acidic group in the resin (A) described above.

As the resin (E), any conventional known resins can be used in the present invention as long as they have the above-described properties and, for example, the conventionally known resins decribed above for the resin (C) can be used.

More specifically, examples of the resin (E) are (meth)acrylic copolymers each containing the aforesaid monomer shown by formula (III) described above as the copolymer component in a proportion of at least 30% by weight of the copolymer.

Furthermore, the resin (E) of the present invention may further contain other components together with the above-described monomer shown by formula (III) and the above-described monomer having an acidic group as other copolymer components. Specific examples of such monomers are those illustrated above as the monomers which can be contained in the resin (C) as other copolymer components.

Moreover, the binder resin of the present invention may further contain other resins in addition to the resin (A) and the resin (D) or (E). Examples of these resins are alkyd resins, polybutyral resins, polyolefins, ethylene-vinyl acetate copolymers, styrene resins, styrene-butadiene resins, acrylate-butadiene resins, and vinyl alkanoate resins.

However, when the content of these other resins exceeds 30% by weight of the resins (A) and (D) or (E), the effect of the present invention (in particular, the improvement of electrostatic characteristics) of this invention cannot be obtained.

The compounding ratio of the resin (A) to any of the resins (C) to (E) differs depending upon the type of an inorganic photoconductive material to be used, the particle sizes of the photoconductive particles, and the surface state thereof, but is generally 5 to 80/95 to 20 (weight ratio), and preferably 15 to 60/85 to 40 (weight ratio).

The ratio of the weight average molecular weight of the resin (A) to the resin (C) to (E) is preferably at least 1.2, and more preferably at least 2.0.

The inorganic photoconductive substance used in the present invention includes zinc oxide, titanium oxide, zinc sulfide, cadmium sulfide, cadmium carbonate, zinc selenide, cadmium selenide, tellurium selenide, lead sulfide, etc., preferably zinc oxide.

The total amount of the binder resins used for the inorganic photoconductive substance is from 10 to 100 parts by weight, and preferably from 15 to 50 parts by weight of the photoconductive material.

In the present invention, various kinds of dyes can be used, if necessary, for the photoconductive layers as spectral sensitizers. Examples of these dyes are carbonium series dyes, diphenylmethane dyes, triphenylmethane dyes, xanthene series dyes, phthalein series dyes, polymethine dyes (e.g., oxonol dyes, merocyanine dyes, cyanine dyes, rhodacyanine dyes, and styryl dyes), and phthalocyanine dyes (which may contain metals) described in Harumi Miyamoto and Hidehiko Takei, *Imaging*, 1973, (No. 8), page 12, C. J. Young, et al, *RCA Review*, 15, 469 (1954), Kohei Kiyota, *Journal of Electric Communication Society of Japan*, J 63 C (No. 2), 97 (1980), Yuji Harasaki et al, *Kogyo Kagaku Zasshi*, 66, 78 and 188 (1963), and Tadaaki Tani, *Journal of the Society of Photographic Science and Technology of Japan*, 35, 208 (1972).

Specific examples of suitable carbonium series dyes, triphenylmethane dyes, xanthene series dyes, and phthalein series dyes are described in JP-B-51-452, JP-A-50-90334, JP-A-50-114227, JP-A-53-39130, JP-A-53-82353, U.S. Pat. Nos. 3,052,540 and 4,054,450 and JP-A-57-16455.

Also, polymethine dyes such as oxonol dyes, merocyanine dyes, cyanine dyes, and rhodacyanine dyes which can be used are those dyes described in F. M. Hammer, *The Cyanine Dyes and Related Compounds*, and, more specifically, the dyes described in U.S. Pat. Nos. 3,047,384, 3,110,591, 3,212,008, 3,125,447, 3,128,179, 3,132,942, and 3,622,317, British Patents 1,226,892, 1,309,274, and 1,405,898, and JP-B-48-7814 and JP-B-55-18892.

Furthermore, polymethine dyes capable of spectrally sensitizing in the wavelength region of from near infrared to infrared longer than 700 nm are described in, JP-A-47-840, JP-A-47-44180, JP-B-51-41061 JP-A-49-5034, JP-A-49-45122, JP-A-57-46245, JP-A-56-35141, JP-A-57-157254, JP-A-61-26044, and JP-A-61-27551, U.S. Pat. Nos. 3,619,154 and 4,175,956, and *Research Disclosure*, 216, 117 to 118 (1982). The light-sensitive material of the present invention is excellent in that, even when various sensitizing dyes are used for the photoconductive layer, the performance thereof is reluctant to vary by such sensitizing dyes. Further, if desired, the photoconductive layers may further contain various additives commonly employed in electrophotographic photoconductive layers, such as chemical sensitizers. Examples of such additives are electron-acceptive compounds (e.g., halogen, benzoquinone, chloranil, acid anhydrides, and organic carboxylic acids) described in *Imaging*, 1973, (No. 8), page 12, and polyarylalkane compounds, hindered phenol compounds, and p-phenylenediamine compounds described in Hiroshi Kokado, *Recent Photoconductive Materials and Development and Practical Use of Light-sensitive Materials*, Chapters to 6, published by Nippon Kagaku Joho K.K., 1986.

There is no particular restriction on the amount of these additives, but the amount thereof is usually from 0.0001 to 2.0 parts by weight per 100 parts by weight of the photoconductive material.

The thickness of the photoconductive layer is from 1 μm to 100 μm, and preferably from 10 μm to 50 μm.

Also, when the photoconductive layer is used as a charge generating layer of a double layer type electrophotographic light-sensitive material having the charge generating layer and a charge transporting layer, the thickness of the charge generating layer is from 0.01 μm to 1 μm, and preferably from 0.05 μm to 0.5 μm.

As the case may be, an insulating layer is formed on the photoconductive layer for the protection of the photoconductive layer and the improvement of the durability and the dark decay characteristics of the photoconductive layer. In this case, the thickness of the insulating layer is relatively thin but, when the light-sensitive material is used for a specific electrophotographic process, the insulating layer having a relatively thick thickness is formed.

In the latter case, the thickness of the insulating layer is from 5 μm to 70 μm, and particularly from 10 μm to 50 μm.

As the charge transporting material for the double layer type light-sensitive material, there are polyvinylcarbazole, oxazole series dyes, pyrazoline series dyes, and triphenylmethane series dyes. The thickness of the charge transfer layer is from 5 μm to 40 μm, and preferably from 10 μm to 30 μm.

Resins which can be used for the insulating layer and the charge transporting layer typically include thermoplastic and thermosetting resins such as polystyrene resins, polyester resins, cellulose resins, polyether resins, vinyl chloride resins, vinyl acetate resins, vinyl chloride-vinyl acetate copolymer resins, polyacryl resins, polyolefin resins, urethane resins, epoxy resins, melamine resins, and silicone resins.

The photoconductive layer according to the present invention can be formed on a conventional support. In general, the support for the electrophotographic light-sensitive material is preferably electroconductive. As the electroconductive support, there are base materials such as metals, papers, plastic sheets, etc., rendered electroconductive by the impregnation of a low resistant material, the base materials the back surface of which (the surface opposite to the surface of forming a photoconductive layer) is rendered electroconductive and having coated with one or more layer for preventing the occurrence of curling of the support, the above-described support having formed on the surface a water-resistant adhesive layer, the above-described layer having formed on the surface at least one precoat, and a support formed by laminating thereon a plastic film rendered electroconductive by vapor depositing thereon aluminum, etc.

More specifically, the examples of electroconductive bases materials or conductivity-imparting materials described in Yukio Sakamoto, *Denshi Shashin (Electrophotography)*, 14 (No. 1), 2 to 11 (1975), Hiroyuki Moriga, *Chemistry of Specific Papers*, published by Koobunshi Kankokai, 1975, M. F. Hoover, *J. Macromol. Sci Chem.*, A to 4 (6), 1327–1417 (1970) can be used.

The following examples are intended to illustrate the present invention, but the present invention is not limited thereto.

Synthesis of Resin (A)

Synthesis Example 1 of Resin (A): (A-1)

A mixed solution of 95 g of ethyl methacrylate, and 200 g of tetrahydrofuran was sufficiently degassed under nitrogen gas stream and cooled to −20° C. Then, 1.5 g of 1,1-diphenylbutyl lithium was added to the mixture, and the reaction was conducted for 12 hours. Furthermore, a mixed solution of 5 g of triphenylmethyl methacrylate and 5 g of tetrahydrofuran was sufficiently degassed under nitrogen gas stream, and, after adding the mixed solution to the aforesaid mixture, the reaction was further conducted for 8 hours. The reaction mixture was adjusted to 0° C. and after adding thereto 10 ml of methanol, the reaction was conducted for 30 minutes and the polymerization was terminated.

The temperature of the polymer solution obtained was raised to 30° C. under stirring and, after adding thereto 3 ml of an ethanol solution of 30% hydrogen chloride, the resulting mixture was stirred for one hour. Then, the solvent of the reaction mixture was distilled off under reduced pressure until the whole volume was reduced to a half, and then the mixture was reprecipitated from one liter of petroleum ether.

The precipitates formed were collected and dried under reduced pressure to obtain 70 g of the polymer (A-1) shown below having a weight average molecular weight (Mw) of $8.5\times10^3$.

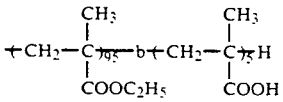

(A-1)

(weight ratio)

In the above formula, b represents a block bond (hereinafter the same).

Synthesis of Resin (A): (A-2)

A mixed solution of 46 g of n-butyl methacrylate, 0.5 g of (tetraphenyl prophinate) aluminum methyl, and 60 g of methylene chloride was raised to a temperature of 30° C. under nitrogen gas stream. The mixture was irradiated with light from a xenon lamp of 300W at a distance of 25 cm through a glass filter, and the reaction was conducted for 12 hours. To the mixture was further added 4 g of benzyl methacrylate, after similarly light-irradiating for 8 hours, 3 g of methanol was added to the reaction mixture followed by stirring for 30 minutes, and then, the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of petroleum ether and the precipitates formed were collected and dried to obtain 33 g of the polymer (A-2) having an Mw of $9.3\times10^3$.

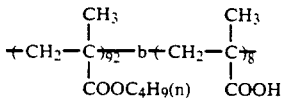

(A-2)

Synthesis Example 3 of Resin (A): (A-3)

A mixed solution of 90 g of 2-chloro-6-methylphenyl methacrylate and 200 g of toluene was sufficiently degassed under nitrogen gas stream and cooled to 0° C. Then, 2.5 g of 1,1-diphenyl-3-methylpentyl lithium was added to the mixture followed by stirring for 6 hours. Further, 10 g of 4-vinylphenyloxytrimethylsilane was added to the mixture and, after stirring the mixture for 6 hours, 3 g of methanol was added to the mixture followed by stirring for 30 minutes.

Then, to the reaction mixture was added 10 g of an ethanol solution of 30% hydrogen chloride and, after stirring the mixture for one hour, the mixture was reprecipitated from one liter of petroleum ether. The precipitates thus formed were collected, washed twice with 300 ml of diethyl ether and dried to obtain 58 g of the polymer (A-3) having an Mw of $7.8\times10^3$.

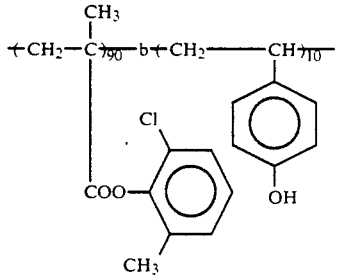

(A-3)

Synthesis Example 4 of Resin (A): (A-4)

A mixture of 95 g of phenyl methacrylate and 4.8 g of benzyl N,N-diethyldithiocarbamate was placed in a vessel under nitrogen gas stream followed by closing the vessel and heated to 60° C. The mixture was irradiated with light from a high-pressure mercury lamp for 400W at a distance of 10 cm through a glass filter for 10 hours to conduct a photopolymerization.

Then, 5 g of acrylic acid and 180 g of methyl ethyl ketone were added to the mixture and, after replacing the gas in the vessel with nitrogen, the mixture was light-irradiated again for 10 hours.

The reaction mixture was reprecipitated from 1.5 liters of hexane and the precipitates formed were collected and dried to obtain 68 g of the polymer (A-4) having an Mw of $9.5\times10^3$.

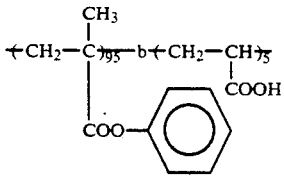

(A-4)

Synthesis Examples 5 to 16 of Resin (A)

By following the same procedures as the above-described synthesis examples of the resin (A), the resins (A) shown in Table 1 below were synthesized.

$\overline{M}w$ of each of the resins obtained was from $6\times10^3$ to $9.5\times10^3$.

TABLE 1
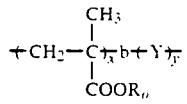
| Synthesis Example | Resin (A) | $-R_o$ | $-Y-$ | x/y |
|---|---|---|---|---|
| 5 | A-5 | 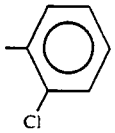 | $-CH_2-C(COOH)-$ | 96/4 |
| 6 | A-6 | 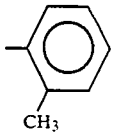 | $-CH_2-C(CH_3)(COOH)-$ | 96/4 |
| 7 | A-7 | 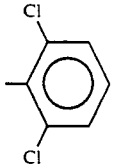 | $-CH_2-C(CH_3)(COOH)-$ | 95/5 |
| 8 | A-8 | 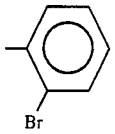 | $-CH_2-CH(COO(CH_2)_2COOH)-$ | 92/8 |
| 9 | A-9 | 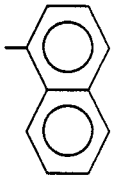 | $-CH(CH_3)-CH(COOH)-$ | 95/5 |
| 10 | A-10 | 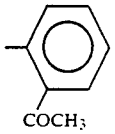 | $-CH_2-C(CH_3)(COO(CH_2)_2-O-P(=O)(OH)-OH)-$ | 97/3 |
| 11 | A-11 | 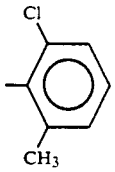 | $-CH_2-CH(COO(CH_2)_2-O-P(=O)(OC_2H_5)-OH)-$ | 90/10 |
| 12 | A-12 | 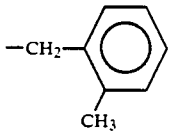 | $-CH_2-C(CH_3)(COO(CH_2)_3SO_3H)-$ | 98/2 |
| 13 | A-13 | 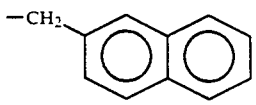 | 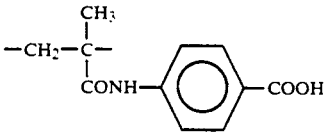 | 95/5 |

TABLE 1-continued

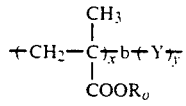

| Synthesis Example | Resin (A) | $-R_o$ | $-Y-$ | x/y |
|---|---|---|---|---|
| 14 | A-14 | 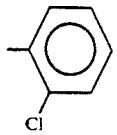 | 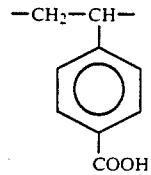 | 94/6 |
| 15 | A-15 | 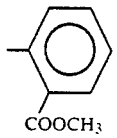 | $-CH_2-CH-$ (COOH) | 94/6 |
| 16 | A-16 | 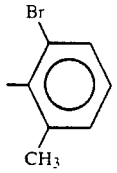 | $-CH_2-C-$ ($CH_3$, COOH) | 95/5 |
| 17 | A-17 | $-C_3H_7$ | $-CH_2-C-$ ($CH_3$, $COO(CH_2)_2COOH$) | 95/5 |
| 18 | A-18 | $-CH_2C_6H_5$ | $-CH_2-CH-$ (COOH) | 96/4 |

Synthesis Examples 19 to 23 of Resin (A)

By following the same procedure as Synthesis Example 4 of the resin (A), the resins (A) shown in Table 1-2 shown below were synthesized. $\overline{M}w$ of each resin obtained was from $8\times10^3$ to $1\times10^4$.

TABLE 1-2

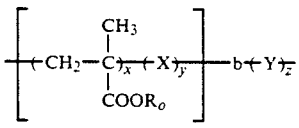

| Synthesis Example | Resin (A) | $-R_o$ | $-X-$ | $-Y-$ | x/y/z (weight ratio) |
|---|---|---|---|---|---|
| 19 | A-19 | $-CH_3$ | $-CH_2-CH-$ ($COOC_2H_5$) | $-CH_2-CH-$ (COOH) | 65/30/5 |
| 20 | A-20 | $-C_2H_5$ | $-CH_2-CH-$ ($COOCH_3$) | $-CH_2-C-$ ($CH_3$, $COO(CH_2)_2O-P(=O)(OH)-OH$) | 72/25/3 |
| 21 | A-21 | 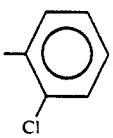 | $-CH_2-CH-$ ($COOCH_2C_6H_5$) | $-CH_2-C-$ ($CH_3$, COOH) | 81/15/4 |

TABLE 1-2-continued

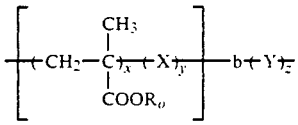

| Synthesis Example | Resin (A) | $-R_0$ | $-X-$ | $-Y-$ | x/y/z (weight ratio) |
|---|---|---|---|---|---|
| 22 | A-20 | 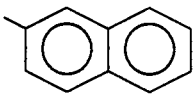 | " | $-CH(CH_3)-CH(COOH)-$ | 75/20/5 |
| 23 | A-23 | 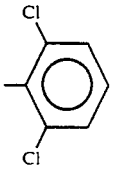 | $-CH_2-CH(COOCH_3)-$ | $-CH_2-CH(COO(CH_2)_2COOH)-$ | 75/20/5 |

EXAMPLE 1 AND COMPARATIVE EXAMPLES A-1 TO C-1

A mixture of 40 g (as solid content) of the resin (A-1) obtained in Synthesis Example 1 of the resin (A), 200 g of zinc oxide, 0.018 g of Cyanine Dye (I) shown below, 0.10 g of phthalic anhydride, and 300 g of toluene was dispersed in a ball mill to prepare a coating composition for a photoconductive layer. The coating composition was coated on a paper, which had been subjected to an electrically conductive treatment, at a dry coverage of 18 g/m$^2$ with a wire bar and dried for 30 seconds at 110° C. Then, the coated paper was allowed to stand in the dark for 24 hours under the conditions of 20° C. and 65% RH to obtain an electrophotographic light-sensitive material.

Cyanine Dye (I):

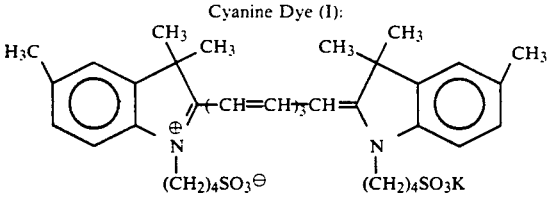

COMPARATIVE EXAMPLE A-1

An electrophotographic light-sensitive material was prepared by following the same procedure as Example 1 described above except that 40 g of resin (R-1) having the following structure was used in place of 40 g of the resin (A-1).

Comparative Resin (R-1):

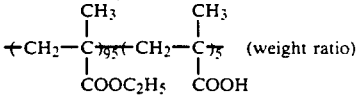

$\overline{M}w$ 8 × 10$^3$ (random copolymer)

COMPARATIVE EXAMPLE B-1

An electrophotographic light-sensitive material was prepared by following the same procedure as Example 1 described above except that 40 g of resin (R-2) having the structure shown below (a charging ratio of ethyl methacrylate/ mercaptopropionic acid was 95/5 by weight) was used in place of 40 g of the resin (A-1).

Comparative Resin (R-2):

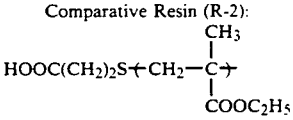

$\overline{M}w$ 7.5 × 10$^3$

COMPARATIVE EXAMPLE C-1

An electrophotographic light-sensitive material was prepared by following the same procedure as Example 1 described above except that 40 g of resin (R-3) having the structure shown below was used in place of 40 g of the resin (A-1).

Comparative Resin (R-3):

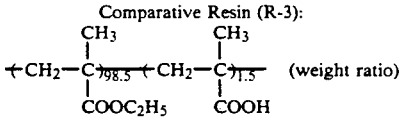

$\overline{M}w$ 4.3 × 10$^4$ (random copolymer)

The filming property (surface smoothness), the film strength, the electrostatic characteristics, the image-forming performance at 20° C., 65% RH, and the image-forming performance under environmental conditions at 30° C., 80% RH of each of the electrophotographic light-sensitive materials were determined.

The results obtained are shown in Table 2 below.

TABLE 2

| | Example 1 | Comparative Example A-1 | Comparative Example B-1 | Comparative Example C-1 |
|---|---|---|---|---|
| Smoothness of Photo-*1 conductive Layer (sec/cc) | 135 | 130 | 125 | 130 |
| Electrostatic*2 Characteristics | | | | |
| $V_{10}$ (−V) | 500 | 500 | 505 | 450 |
| DRR (%) | 75 | 65 | 70 | 40 |
| $E_{1/10}$ (erg/cm$^2$) | 38 | 45 | 38 | 105 |
| $E_{1/100}$ (erg/cm$^2$) | 59 | 88 | 73 | 200 or more |
| Image Forming*3 Performance | | | | |
| I: (20° C., 65% RH) | ○ good | Δ Dm lowered. Fine lines and letters are slightly blurred. | Δ~○ Dm lowered. | XX Large background fog. Dm of image lowered. |
| II: (30° C., 80% RH) | ○ good | X~Δ Dm lowered. Background fog formed. | Δ Dm lowered. Fine lines and letters are slightly blurred. | XXX Background fog cannot distinguished from images. |

The above evaluations were conducted as follows.

*1) Smoothness of Photoconductive Layer

The smoothness (sec/cc) of each light-sensitive material was measured using a Beck Smoothness Test Machine (manufactured by Kumagaya Riko K.K.) under an air volume of 1 cc.

*2) Electrostatic Characteristics

Each light-sensitive material was charged by applying thereto corona discharging of −6 kV for 20 seconds using a paper analyzer (Paper Analyzer Type SP-428, manufactured by Kawaguchi Denki K.K.) in the dark at a temperature of 20° C., 65% RH and then allowed to stand for 10 seconds. The surface potential $V_{10}$ in this case was measured. Then, the sample was allowed to stand for 180 seconds in the dark and then the potential $V_{190}$ was measured. The dark decay retention [DRR (%)], i.e., the percent retention of potential after decaying for 180 seconds in the dark, was calculated from the following formula: DRR (%)$=(V_{190}/V_{10})\times 100$ (%).

Also, the surface of the photoconductive layer was charged to −400V by corona discharging, then irradiated by monochromatic light of a wavelength of 780 nm, the time required for decaying the surface potential ($V_{10}$) to 1/10 thereof, and the exposure amount $E_{1/10}$ (erg/cm$^2$) was calculated therefrom.

Further, in a similar manner to the determination of $E_{1/10}$, the exposure amount $E_{1/100}$ (erg/cm$^2$) was determined by measuring the time for decaying the surface potential ($V_{10}$) to 1/100 thereof.

*3) Image Forming Performance

Each light-sensitive material was allowed to stand a whole day and night under the following conditions. Then, each sample was charged to −5 kV, exposed by scanning with a gallium-aluminum-arsenic semiconductor laser (oscillation wavelength 780 nm) of 2.8 mW output as a light source at an exposure amount on the surface of 64 erg/cm$^2$, at a pitch of 25 μm, and a scanning speed of 350 m/sec., and developed using ELP-T (made by Fuji Photo Film Co., Ltd.) as a liquid developer followed by fixing. Then, the reproduced images (fog, image quality) were visually evaluated.

The environmental conditions at the image formation were 20° C., 65% RH and 30° C., 80% RH.

As is clear from the results shown in Table 2 above, the smoothness of the photoconductive layer was almost the same in each light-sensitive material. However, the electrostatic characteristics were excellent in the light-sensitive material according to the present invention, and, in particular, the light sensitivity in the $E_{1/100}$ value was greatly improved as compared with the comparative light-sensitive materials. This shows that, in the electrophotographic light-sensitive material of the present invention, the potential remaining at the domain corresponding to the non-imaged portions after light exposure is not lowered. On the other hand, when image is actually formed using the comparative light-sensitive materials, the lowering of the remaining potential forms a background fog phenomenon at the non-imaged portions.

The image-forming performance was also excellent in the electrophotographic light-sensitive material of the present invention. The light-sensitive materials in Comparative Examples A-1 and B-1 were better than the sample of Comparative Example C-1, but they were yet unsatisfactory under the imaging condition by the scanning exposure system using a low output semiconductor laser at a high speed.

EXAMPLES 2 AND 3

A mixture of 7.5 g of the above resin (A-2) or 7.5 g of the resin (A-5) having the structure shown below, 32.5 g of poly(ethyl methacrylate) resin (C-1) (Mw $2.4\times 10^5$), 200 g of zinc oxide, 0.018 g of Cyanine Dye (II) shown below, 0.15 g of maleic anhydride, and 300 g of toluene was dispersed in a ball mill for 3 hours to prepare a coating composition for a photoconductive layer. The coating composition was coated on a paper, which had been subjected to an electrically conductive treatment, by a wire bar at a dry coverage of 20 g/m$^2$, and dried for 30 seconds at 110° C. Then, the coated paper was allowed to stand in the dark for 24 hours under the conditions of 20° C., 65% RH to obtain each electrophotographic light-sensitive material.

Cyanine Dye (II):

-continued

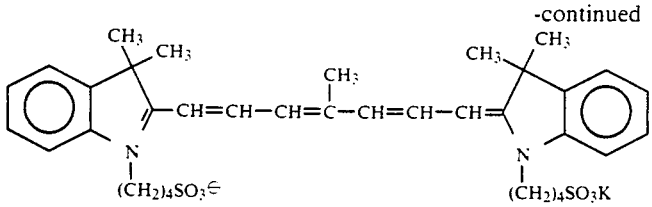

Resin (A-5):

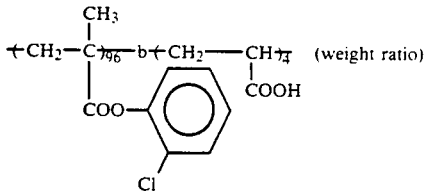

$\overline{M}w$ 7.5 × $10^3$

The smoothness, the film strength, and the electrostatic characteristics of each of the electrophotographic light-sensitive materials were measured by the same methods as described in Example 1.

Furthermore, each electrophotographic light-sensitive material was used as an offset master plate and, after subjecting the light-sensitive material to an oil-desensitizing treatment, printing was conducted.

The results obtained are shown in Table 3 below.

TABLE 3

| | Example 2 | Example 3 |
|---|---|---|
| Smoothness of Photoconductive Layer (sec/cc) | 130 | 135 |
| Strength of Photoconductive Layer*4 (%) | 92 | 91 |
| Electrostatic Characteristics | | |
| $V_{10}$ (−V) | 540 | 605 |
| D.R.R. (%) | 78 | 83 |
| $E_{1/10}$ (erg/cm$^2$) | 36 | 24 |
| $E_{1/100}$ (erg/cm$^2$) | 54 | 37 |
| Image-Forming Performance | | |
| I (20° C., 65%) | ○ good | ◎ very good |
| II (30° C., 80%) | ○ Good | ◎ very good |
| Contact Angle with Water*5 | below 10° | below 10° |
| Printing Durability*6 | 8,000 prints | 8,000 prints |

*4) Mechanical Strength of Photoconductive Layer

The surface of each light-sensitive material was repeatedly rubbed 1,000 times with emery paper (#1000) under a load of 50 g/cm$^2$ using a Heidon 14 Model surface testing machine (manufactured by Shinto Kagaku K.K.). After removing abrasion dusts from the layer, the film retention (%) was determined from the weight loss of the photoconductive layer, which was referred to as the mechanical strength.

*5) Contact Angle with Water

Each light-sensitive material was passed once through an etching processor using an oil-desensitizing solution ELP-EX (made by Fuji Photo Film Co., Ltd.) diluted to a 2-fold volume with distilled water to desensitize the surface of the photoconductive layer. Then, one drop of distilled water (2 μl) was placed on the surface, and the contact angle between the surface and the water drop formed thereon was measured using a goniometer.

*6) Printing Durability

Each light-sensitive material was subjected to the plate making under the same condition as described in *4) to form a toner image, the sample was oil-desensitized under the same condition as in *5) described above, and the printing plate thus prepared was mounted on an offset printing machine (Oliver Model 52, manufactured by Sakurai Seisakusho K.K.) as an offset master plate followed by printing. Then, the number of prints obtained without causing background staining on the non-image portions of prints and problems on the quality of the image portions was referred to as the printing durability. (The larger the number of prints, the higher the printing durability.)

As is clear from the results in Table 3 above, each of the electrophotographic light-sensitive materials showed good electrophotographic characteristics. In particular, the light-sensitive material in Example 3 using the resin (A) composed of the methacrylate component having the specific substituent further showed a good light-sensitivity and good dark decay retentivity.

Also, when each of the light-sensitive materials was used as an offset master plate, the oil-desensitizing treatment with an oil-desensitizing solution was sufficiently applied and the contact angle of the non-imaged portion with a water drop was as small as 10 degree or below, which showed that the non-imaged portions were sufficiently rendered hydrophilic. When each master plate was actually used for printing, no background stain of prints was observed.

EXAMPLES 5 TO 15

A mixture of 6 g of each of the resins (A) shown in Table 4 below, 34 g of poly(butyl methacrylate) (Mw 3.6×$10^4$): resin (C-1), 200 g of zinc oxide, 0.016 g of Cyanine Dye (III) having the structure shown below, 0.20 g of salicylic acid, and 300 g of toluene was dispersed in a ball mill for 3 hours to prepare a coating composition for a photoconductive layer. The coating composition was coated on a paper, which had been subjected to an electrically conductive treatment, by a wire bar at a dry coverage of 22 g/cm$^2$, and dried for 30 seconds at 110° C. Then, the coated paper was allowed to stand in the dark for 24 hours under the conditions of 20° C., 65% RH to obtain each electrophotographic light-sensitive material.

Cyanine dye (III):
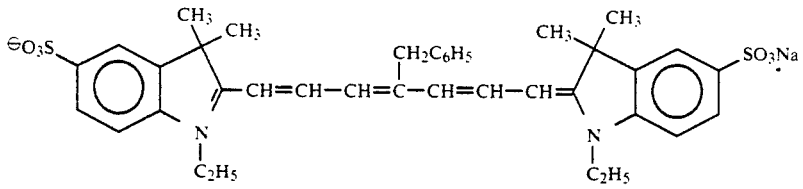
TABLE 4
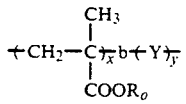
$\overline{M}w$ of each resin (A) was from $6 \times 10^3$ to $9.5 \times 10^3$.
| Example | Resin (A) | $-R_o$ | $-Y-$ | x/y |
|---|---|---|---|---|
| 5 | A-6 | 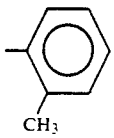 | 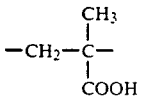 | 96/4 |
| 6 | A-7 | 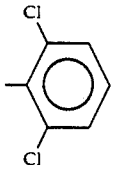 | 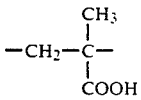 | 95/5 |
| 7 | A-8 | 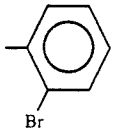 | 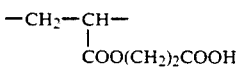 | 92/8 |
| 8 | A-9 | 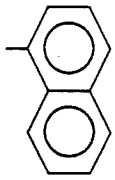 | 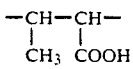 | 95/5 |
| 9 | A-10 | 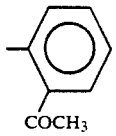 | 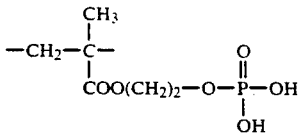 | 97/3 |
| 10 | A-11 | 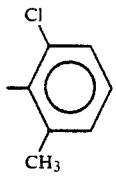 | 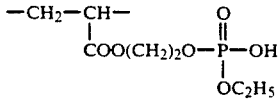 | 90/10 |
| 11 | A-12 | 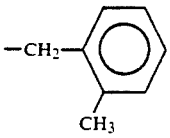 | 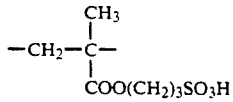 | 98/2 |

TABLE 4-continued

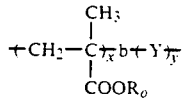

$\overline{M}w$ of each resin (A) was from $6 \times 10^3$ to $9.5 \times 10^3$.

| Example | Resin (A) | $-R_o$ | $-Y-$ | x/y |
|---|---|---|---|---|
| 12 | A-13 | 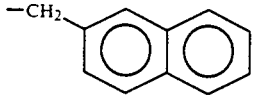 | 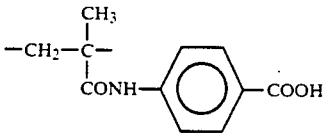 | 95/5 |
| 13 | A-14 | 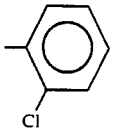 | 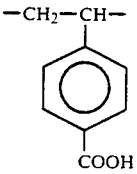 | 94/6 |
| 14 | A-15 | 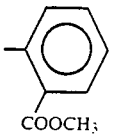 | 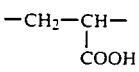 | 94/6 |
| 15 | A-16 | 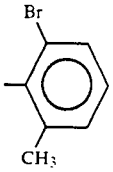 | 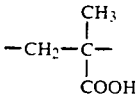 | 95/5 |

Each of the electrophotographic light-sensitive materials of the present invention showed good strength of the photoconductive layer and the good electrostatic characteristics, and the images actually formed showed clear image quality having no background fog even under a high-temperature high-humidity condition (30° C., 80% RH).

Furthermore, when each of the light-sensitive materials thus toner developed was used for printing as an offset master plate, 8,000 prints having good image quality could be obtained.

EXAMPLES 16 TO 25

A mixture of 6 g (as solid content) of the above-described resin (A-7), 34 g of each of the resins (D) shown in Tale 5 below, 0.02 g of heptamethinecyanine dye (IV) having the structure shown below, 0.15 g of phthalic anhydride, and 300 g of toluene was dispersed in a ball mill for 3 hours to prepare a coating composition for a photoconductive layer. Then, by following the same procedure as Example 1 using each coating composition thus prepared, each electrophotographic light-sensitive material was prepared.

Heptamethinecyanine Dye (IV):

-continued

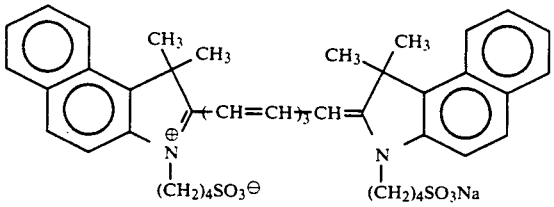

TABLE 5

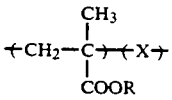

(The numeral shown in the table shows a weight composition ratio)

| Resin (D) | R | —X— | | Weight Average Molecular Weight (× $10^4$) |
|---|---|---|---|---|
| D-1 | $-C_2H_5$ 96 | 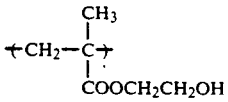 | 4 | 12 |

TABLE 5-continued

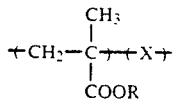

(The numeral shown in the table shows a weight composition ratio)

| Resin (D) | R | —X— | | Weight Average Molecular Weight (× $10^4$) |
|---|---|---|---|---|
| D-2 | $-C_2H_5$ 95 | 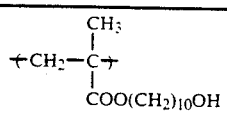 | 5 | 9.5 |
| D-3 | $-C_4H_9$ 98 | 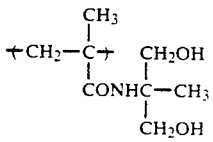 | 2 | 10 |
| D-4 | $-C_4H_9$ 97 | 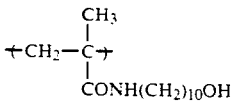 | 3 | 11.5 |
| D-5 | $-C_4H_9$ 96 | 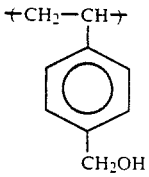 | 4 | 20 |
| D-6 | $-C_2H_5$ 95 | 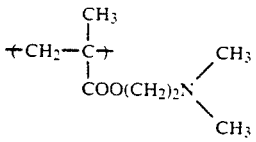 | 5 | 8.8 |
| D-7 | $-C_3H_7$ 95 | 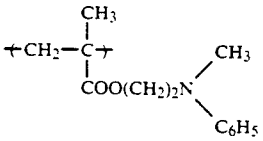 | 5 | 9.5 |

TABLE 5-continued

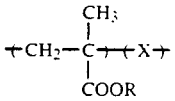

(The numeral shown in the table shows a weight composition ratio)

| Resin (D) | R | —X— | | Weight Average Molecular Weight (× $10^4$) |
|---|---|---|---|---|
| D-8 | $-C_4H_9$ 96 | 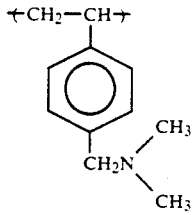 | | 10.5 |
| D-9 | $-C_2H_5$ 97 | 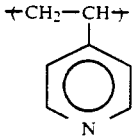 | 3 | 10.5 |
| D-10 | $-C_4H_9$ 95 | 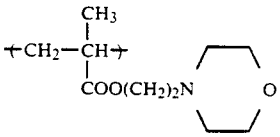 | 5 | 13 |

Each of the electrophotographic light-sensitive materials was tested for the electrostatic characteristics using a paper analyzer as described in Example 1. In this case, however, a gallium-aluminum-arsenic semiconductor laser (oscillation wave length 830 nm) was used as a light source.

The results obtained are shown in Table 6 below.

TABLE 6

| Example | Resin (D) | $V_{10}$ (−V) | D.R.R. | $E_{1/10}$ (erg/cm$^2$) | Image-Forming Performance (30° C., 80% RH) | Printing Durability |
|---|---|---|---|---|---|---|
| 16 | D-1 | 600 | 86 | 20 | Good | 8000 prints |
| 17 | D-2 | 605 | 87 | 18 | " | " |
| 18 | D-3 | 600 | 87 | 19 | " | 9000 prints |
| 19 | D-4 | 605 | 87 | 20 | " | " |
| 20 | D-5 | 610 | 88 | 17 | " | 8000 prints |
| 21 | D-6 | 580 | 85 | 22 | " | " |
| 22 | D-7 | 585 | 85 | 23 | " | " |
| 23 | D-8 | 580 | 83 | 23 | " | " |
| 24 | D-9 | 590 | 85 | 21 | " | " |
| 25 | D-10 | 595 | 86 | 20 | " | " |

EXAMPLES 26 TO 37

A mixture of 7 g of the above-described resin (A-10), 33 g of each of the resins (E) shown in Table 7 below, 0.020 g of Cyanine dye (V) having the structure shown below, 0.15 g of maleic anhydride, 200 g of zinc oxide, and 300 g of toluene was dispersed in a ball mill for 3 hours to prepare a coating composition for a photoconductive layer. Then, by following the same procedure as in Example 1 using the above-described coating composition, each of the electrophotographic light-sensitive materials was prepared.

Cyanine Dye (V):

-continued

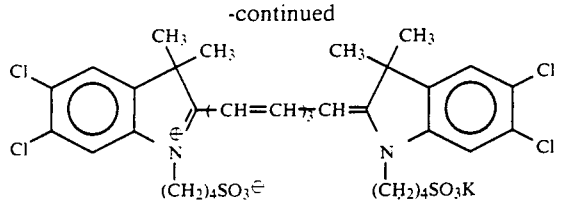

TABLE 7

Resin (E)

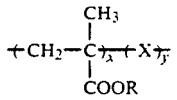

(x and y show the weight composition ratio)

| Example | Resin (E) | R, x | —X— | y | Weight Average Molecular Weight (× $10^5$) |
|---|---|---|---|---|---|
| 26 | E-1 | $-C_2H_5$ 99.5 | $+CH_2-CH+$ (COOH) | 0.5 | 1.8 |
| 27 | E-2 | $-C_2H_5$ 99.5 | $+CH_2-C+$ ($CH_3$, COOH) | 0.5 | 2.0 |
| 28 | E-3 | $-C_2H_5$ 99.2 | $+CH_2-C+$ ($CH_3$, $CONH(CH_2)_{10}COOH$) | 0.8 | 2.1 |
| 29 | E-4 | $-C_4H_9$ 99.7 | $+CH_2-C+$ ($CH_3$, $COO(CH_2)_2P(=O)(OH)-OH$) | 0.3 | 2.5 |
| 30 | E-5 | $-C_4H_9$ 99.7 | $+CH_2-C+$ ($CH_3$, $COO(CH_2)_3SO_3H$) | 0.3 | 1.5 |
| 31 | E-6 | $-C_2H_5$ 99.5 | $+CH_2-CH+$ (C6H4-COOH) | 0.5 | 1.1 |
| 32 | E-7 | $-CH_2C_6H_5$ 99.4 | $+CH_2-C+$ ($CH_3$, $COO(CH_2)_3OCO(CH_2)_3COOH$) | 0.6 | 2.1 |
| 33 | E-8 | $-C_3H_7$ 99.4 | $+CH_2-C+$ ($CH_3$, $CH_3$) | 0.6 | 2.2 |
| 34 | E-9 | $-C_4H_9$ 99.5 | $+CH_2-C+$ ($CH_3$, CONH-C6H4-COOH) | 0.5 | 2.0 |

TABLE 7-continued

Resin (E)

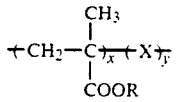

(x and y show the weight composition ratio)

| Example | Resin (E) | R, x | —X— | y | Weight Average Molecular Weight (× $10^5$) |
|---|---|---|---|---|---|
| 35 | E-10 | $-C_3H_7$ 99.7 | 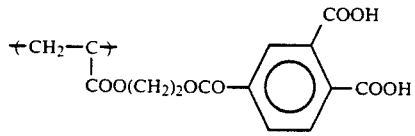 | 0.3 | 2.1 |
| 36 | E-11 | $-C_2H_5$ 99.7 | 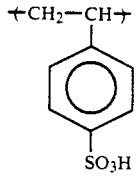 | 0.3 | 1.6 |
| 37 | E-12 | $-C_2H_5$ 99.4 | 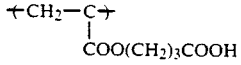 | 0.6 | 2.2 |

Each of the electrophotographic light-sensitive materials was excellent in the charging property, dark charge retentivity and light sensitivity, and, at actual image formation, each of the light-sensitive materials showed clear images having neither the formation of background stains and the occurrence of fine line cutting even under severe conditions of high temperature and high humidity (30° C., 80% RH).

Furthermore, each printing plate was prepared in the same manner as described in Example 1 and, when 10,000 prints were printed using the printing plate as an offset master plate, prints of clear image quality having no background stains were obtained.

EXAMPLES 38 TO 43 AND COMPARATIVE EXAMPLE D-1

A mixture of 8 g of the above-described resin (A-2), 32 g of each of the resins (C) to (E) shown in Table 8 below, 200 g of zinc oxide, 0.02 g of uranine, 0.04 g of Rose Bengale, 0.03 g of bromophenol blue, 0.20 g of phthalic anhydride, and 300 g of toluene was dispersed in a ball mill for 2 hours to prepare a coating composition for a photoconductive layer. The coating composition was coated on a paper, which had been subjected to an electrically conductive treatment, with a wire bar at a dry coverage of 20 g/m$^2$, and dried for one minute at 110° C. Then, the coated paper was allowed to stand in the dark for 24 hours under the conditions of 20° C., 65% RH to obtain each electrophotographic light-sensitive material.

TABLE 8

Resins (C) to (E)

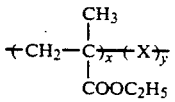

The weight average molecular weights of resins (C) to (E) were from 1.5 × $10^5$ to 2.5 × $10^5$.

| Example | x/y (weight ratio) | —X— | Electrophotographic Characteristics*7 $V_{10}$ (−V) | D.R.R. (%) | $E_{1/10}$ (lux · sec) | Printing Durability |
|---|---|---|---|---|---|---|
| 38 | 100/0 | — | 550 | 90 | 5.6 | 8000 prints |
| 39 | 96/4 | 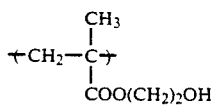 | 545 | 91 | 5.2 | 8000 prints |

TABLE 8-continued

Resins (C) to (E)

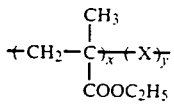

The weight average molecular weights of resins (C) to (E) were from $1.5 \times 10^5$ to $2.5 \times 10^5$.

| Example | x/y (weight ratio) | —X— | Electrophotographic Characteristics*7 $V_{10}$ (−V) | D.R.R. (%) | $E_{1/10}$ (lux · sec) | Printing Durability |
|---|---|---|---|---|---|---|
| 40 | 95/5 | 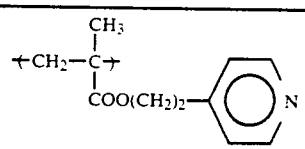 | 545 | 90 | 5.7 | 8000 prints |
| 41 | 99.6/0.4 |  | 550 | 93 | 4.8 | >10,000 prints |
| 42 | 99.7/0.3 | 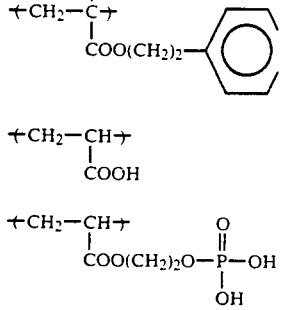 | 555 | 94 | 4.9 | >10,000 prints |
| 43 | 99.7/0.3 | 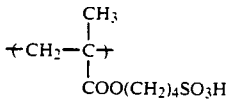 | 545 | 93 | 5.0 | >10,000 prints |
| Comparative D-1 | | 40 g of Resin (R-3) only in Comparison Example C-1 was used. | 550 | 84 | 15.0 | Background stain formed at the beginning of printing |

The above evaluation were conducted as follows:

*7) Electrostatic Characteristics

Each light-sensitive material was charged by applying thereto corona discharging of −6 kV for 20 seconds using a paper analyzer (Paper Analyzer Type SP-428, manufactured by Kawaguchi Denki K.K.) in the dark at a temperature of 20° C., 65% RH and then allowed to stand for 10 seconds. The surface potential $V_{10}$ in this case was measured. Then, the sample was allowed to stand for 60 seconds in the dark and then the potential $V_{70}$ was measured. The dark decay retention [DRR (%)], i.e., the percent retention of potential after decaying for 170 seconds in the dark, was calculated from the following formula: DRR (%)=$(V70/V_{10})\times 100$ (%).

Also, the surface of the photoconductive layer was charged to −400V by corona discharging, then irradiated by visible light of the illuminance of 2.0 lux, the time required for decaying the surface potential ($V_{10}$) to 1/10 thereof, and the exposure amount $E_{1/10}$ (lux·sec) was calculated therefrom.

In addition, the offset master plate for printing was prepared by the following conditions.

Each electrophotographic light-sensitive material was allowed to stand a whole day and night under the environmental conditions of 20° C., 65% RH (I) or 30° C., 80% RH (II), the light-sensitive material was image exposed and developed by a full-automatic processor ELP-404V (trade name, made by Fuji Photo Film Co., Ltd.) using ELP-T as a toner and images (fog and the quality of image) formed was visually evaluated.

The electrophotographic light-sensitive materials of the present invention and Comparative Example D-1 are examples wherein the spectral sensitizing dye is replaced by 3 kinds of dyes sensitizing at the visible light region. In the electrophotographic light-sensitive material of Comparative Example D-1 using a conventional random copolymer as the binder resin, $V_{10}$ could keep the level of the resin Of the present invention, but dark decay retentivity (DRR) was lowered, and also $E_{1/10}$ was lowered. The value of $E_{1/10}$ has a relation with that a background stain is liable to form in an actual image formed. Therefore, when the exposure amount at the image formation is increased for retaining the formation of the background stain, cutting of fine lines and letters occurs.

EXAMPLES 44 TO 46

By following the same procedure as Example 38 except that 6.5 g of the resin (A-2) was used in place of 8 g of the same resin and 33.5 g of each of the resins (E) shown in Table 9 was used in place of 32 g of the resin (C-1), each of electrophotographic light-sensitive materials was prepared.

TABLE 9

| Example | Resin (E) |
|---|---|
| 44 | Dianal L-186 (methacrylic copolymer) (trade name, made by Mitsubishi Rayon Co., Ltd. |

TABLE 9-continued

| Example | Resin (E) |
|---|---|
| 45 | 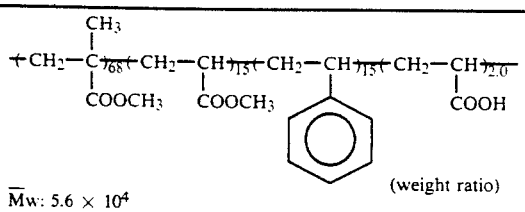 (weight ratio) $\overline{M}w$: $5.6 \times 10^4$ |
| 46 | 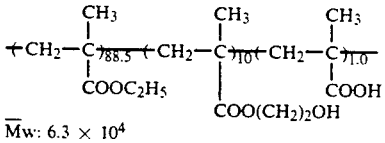 $\overline{M}w$: $6.3 \times 10^4$ |

Each of the electrophotographic light-sensitive materials was good in the strength of the photoconductive layer and the electrostatic characteristics, and at actual image formation, clear images having no background stain were obtained even under a high temperature and high humidity condition (30° C., 80% RH). Furthermore, when the imaged plate was used for printing as an offset master plate, 10,000 prints having good image quality were obtained.

EXAMPLE 47

A mixture of 20 g (as solid components) of the resin (A-1)produced in Synthesis Example 1, 200 g of zinc oxide, 0.02 g Heptamethinecyanine Dye (A) having the formula shown below, 0.15 g of phthalic anhydride and 300 g of toluene was dispersed in a ball mill for 4 hours, and then 15 g of the resin (B-1) having the structure shown below and 5 g of N,N',N'-trimethylethylenediamine were added to the mixture followed by dispersing for 5 minutes to prepare a coating composition for a photoconductive layer. The coating composition was coated on a paper, which had been subjected to an electrically conductive treatment, by a wire bar at a dry coverage of 22 g/m$^2$, and dried for one hour at 100° C. Then, the coated paper was allowed to stand for 24 hours in the dark under the condition of 20° C. and 65% RH to obtain an electrophotographic light-sensitive material.

Resin (B-1):

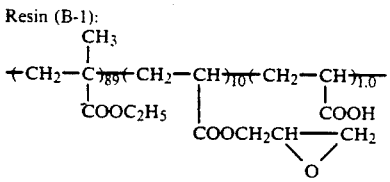

$\overline{M}w$: $3.6 \times 10^4$ (weight ratio)

Cyanine Dye (A):

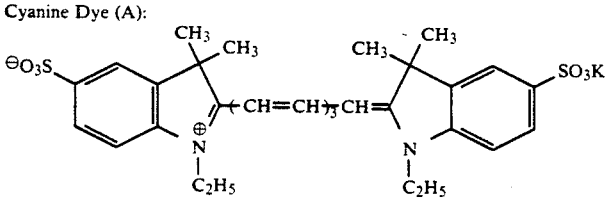

EXAMPLE 48

An electrophotographic light-sensitive material was prepared by following the same procedure as Example 47 except that 20 g (as solid content) of the resin (A-5) was used in place of 20 g of the resin (A-1).

COMPARATIVE EXAMPLE A-2

An electrophotographic light-sensitive material was prepared by following the same procedure as Example 47 except that 20 g of Comparative Resin (R-1) having the structure shown below was used in place of 20 g of the resin (A-1).

Comparative Resin (R-1):

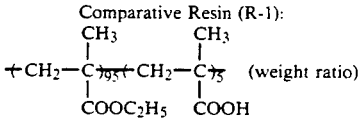

$\overline{M}w$: $6 \times 10^3$ (random copolymer)

COMPARATIVE EXAMPLE B-2

An electrophotographic light-sensitive material was prepared by following the same procedure as Example 47 except that 20 g of Comparative Resin (R-2) having the structure shown below was used in place of 20 g of the resin (A-1).

(R-2):

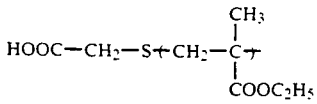

$\overline{M}w$: $8.0 \times 10^3$

COMPARATIVE EXAMPLE C-2

An electrophotographic light-sensitive material was prepared by following the same procedure as Example 47 except that 20 g of Comparative Resin (R-3) having the structure shown below was used in place of 20 g of the resin (A-1).

Resin (R-3):

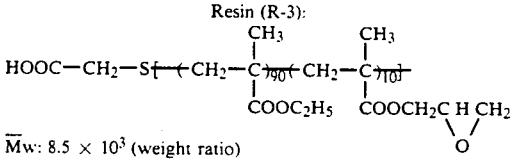

$\overline{M}w$: $8.5 \times 10^3$ (weight ratio)

On each electrophotographic light-sensitive material, the electrostatic characteristics and the image-forming performance under the environmental conditions of (20° C., 65% RH) and (30° C., 80% RH) were determined. The results are shown in Table 10 below.

Also, after charging the surface Of the photoconductive layer to −400 volts by corona discharging, the surface of the photoconductive layer was irradiated by gallium-aluminum-arsenic semiconductor laser (oscillation wavelength 780 nm), the time required to decaying the surface potential ($V_{10}$) to 1/10 was measured, and from the value, the exposure value $E_{1/10}$ (erg/cm$^2$) was calculated.

The environmental conditions at the measurement were 20° C., 65% RH (I) and 30° C., 80% (II).

*2) Image-forming performance

After allowing to stand each electrophotographic light-sensitive material a whole day and night under the environmental conditions of 20° C., 65% RH(I) and 30° C., 80% RH (II), each light-sensitive material was charged to −6 kV, and after scanning the surface of the light-sensitive material using a gallium-aluminum-arsenic semiconductor laser (oscillation wavelength 780 nm) as the light source at a pitch of 25 μm and a scanning speed of 300 meters/second under the illuminance of 64 erg/cm$^2$, the light-sensitive material was developed using a liquid developer, ELP-T (trade name, made by Fuji Photo Film Co., Ltd.) and fixed. Then, the images (fog and image quality) were visually evaluated.

As shown in Table 10 above, each of the electrophotographic light-sensitive materials according to the present invention had good electrostatic characteristics and at actual image formation, clear images having good image quality without background fog were obtained.

TABLE 10

| | Example 47 | Example 48 | Comparative Example A-2 | Comparative Example B-2 | Comparative Example C-2 |
|---|---|---|---|---|---|
| Electrostatic Characteristics*1) | | | | | |
| $V_{10}$ (−V) | | | | | |
| I: (20° C., 65% RH) | 480 | 600 | 430 | 460 | 465 |
| II: (30° C., 80% RH) | 470 | 585 | 400 | 445 | 450 |
| DRR (90 sec. value) (%) | | | | | |
| I: (20° C., 65% RH) | 78 | 85 | 70 | 75 | 75 |
| II: (30° C., 80% RH) | 73 | 80 | 60 | 68 | 67 |
| $E_{1/10}$ (erg/cm$^2$) | | | | | |
| I: (20° C., 60% RH) | 40 | 28 | 63 | 46 | 50 |
| II: (30° C., 80% RH) | 38 | 25 | 56 | 42 | 46 |
| Image Forming Performance*2) | | | | | |
| I: (20° C., 65% RH) | good | Very good | X~Δ Background fog formed. Dm lowered. | (Δ) Dm lowered. Fine lines are difficult to form. | Δ Dm lowered. Fine lines are difficult to form. |
| II: (30° C., 80% RH) | good | Very good | X Many background fog. Fine lines are not formed. | Δ Dm lowered. Fine lines are difficult to form. | Δ Dm lowered. Fine lines are difficult to form. |

The terms shown in Table 10 were evaluated as follows.

*1): Electrostatic characteristics

After applying corona discharging to each electrophotographic light-sensitive material for 20 seconds at −6 kV using a paper analyzer (Paper Analyzer Type SP-428, trade name, made by Kawaguchi Denki K.K.) in the dark at 20° C., the light-sensitive material was allowed to stand for 10 seconds and the surface potential $V_{10}$ in this case was measured. Then, the light-sensitive material was allowed to stand in the dark for 90 seconds as it was and, thereafter, the surface potential $V_{100}$ was measured. Then, the potential retentivity after decaying for 90 seconds, i.e., the dark decay retentivity [DRR (%)]was determined by $(V_{100}/V_{10}) \times 100$ (%).

On the other hand, in the electrophotographic light-sensitive materials in Comparative Examples A-2 to C-2, the charged potential ($V_{10}$) or the light sensitivity ($E_{1/10}$) was lowered and at actual image formation, the density (Dm) of images was lowered, whereby fine lines, letters, etc., were blurred and also background fog formed.

The above-described results show that, when the resin used in the present invention is used, the electrophotographic light-sensitive material having satisfactory electrostatic characteristics is obtained. Furthermore, in the case of using the resin used in the present invention, it has been noted that the electrophotographic light-sensitive material in Example 48 using the resin (A) has better electrostatic characteristics than the electrophotographic light-sensitive material in Example 47 and, in particular, the former case is more excellent in the semiconductor laser light scanning exposure system.

EXAMPLE 49

A mixture of 10 g (as solid content) of the resin (A-6), 30 g of the resin (B-2) having the structure shown below, 200 g of zinc oxide, 0.018 g of Cyanine Dye (B) having the structure shown below, 0.30 g of phthalic anhydride, and 300 g of toluene was dispersed in a ball mill for 4 hours and, after further adding thereto 4 g of glutaconic acid, the mixture was further dispersed for 10 minutes in a ball mill to prepare a coating composition for a photoconductive layer. The coating composition was coated on a paper, which had been subjected to an electrically conductive treatment, by a wire bar at a dry coverage of 22 g/m$^2$, dried at 100° C. for 30 minutes, heated to 120° C. for one hour, and then the coated paper was allowed to stand in the dark for 24 hours under the conditions of 20° C., 65% RH to obtain an electrophotographic light-sensitive material.

Cyanine Dye (B):

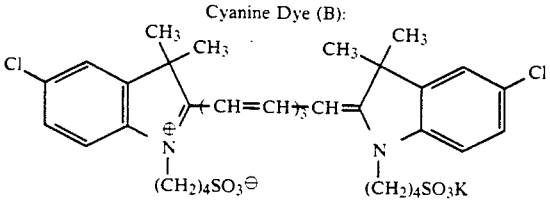

Resin (B-2):

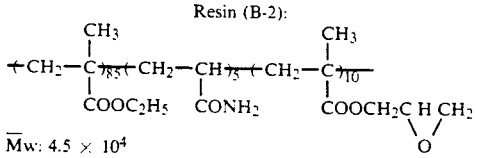

$\overline{M}w$: 4.5 × 10$^4$

The filming property (smoothness of the surface), the film strength, the electrostatic characteristics and the image-forming performance under the environmental conditions of 20° C., 65% RH and 30° C., 80% RH were determined.

The results obtained are shown in Table 11 below.

TABLE 11

| | Example 49 |
|---|---|
| Smoothness of Surface Layer*3) (sec/cc) | 500 |
| Electrophotographic Characteristics | |
| $V_{10}$ (−V) | |
| I: (20° C., 65% RH) | 610 |
| II: (30° C., 80% RH) | 600 |
| D.R.R (120 sec value) (%) | |
| I: (20° C., 65% RH) | 84 |
| II: (30° C., 80% RH) | 81 |
| $E_{1/10}$ (erg/cm$^2$) | |
| I: (20° C., 65% RH) | 29 |
| II: (30° C., 80% RH) | 25 |
| Image-Forming Performance | |
| I: (20° C., 65% RH) | very good |
| II: (30° C., 80% RH) | very good |
| Contact Angle with Water*4) | 10° or below |
| Printing Durability*5) | 6,000 prints |

The above evaluations were conducted as follows.

*3): Smoothness of Photoconductive Layer

The surface smoothness of the electrophotographic light-sensitive material (sec./cc) was measured using a Back smoothness test machine (manufactured by Kumagaya Rikoo K.K.) under a condition of an air volume of 1 cc.

*4): Contact Angle with Water

After the photoconductive layer of each electrophotographic light-sensitive material was subjected to an oil-desensitizing treatment by passing once through an etching processor using a solution formed by diluting an oil-desensitizing treatment solution, ELP-E (trade name, made by Fuji Photo Film Co., Ltd.) to a 2-fold volume with distilled water, a water drop of 2 μl of distilled water was placed on the surface and the contact angle with the water drop formed was measured with a goniometer.

*5): Printing Durability

In the same manner as the image-forming performance in the above-described *2), a printing plate was prepared, and the plate was subjected an oil-desensitizing treatment under the same condition as in aforesaid *4). The printing plate was then mounted on an offset printing machine (Oliver 52 Type, trade name, manufactured by Sakurai Seisakusho) using an offset master plate to print using high quality art papers as printing papers. In this case, the number of prints capable of printing without causing background stains at the non-imaged portions of the prints and without causing problems on the image quality of the imaged portions is shown as the printing durability. (The larger the number of prints, the better the printing durability.)

As shown in Table 11 above, the electrophotographic light-sensitive material of the present invention has a high mechanical strength of the smooth photoconductive layer and good electrostatic characteristics, and at practical image formation, clear images without background fog are obtained. This is presumed to be obtained by that the particles of the photoconductive substance and the binder resin are sufficiently adsorbed to each other and the binder resin coats the surface of the particles.

Also, when the images light-sensitive material is used as an offset master plate, an oil-desensitizing treatment by an oil-desensitizing solution is sufficiently applied and the contact angle between the non-imaged portion and a water- drop is less than 10 degree, which shows the non-imaged portion being sufficiently rendered hydrophilic. At actual printing, no background stain is observed on the prints obtained and 8,000 prints having a clear image quality are obtained.

The above shows that the film strength is greatly improved by the action of the resin (B) or the combination of the resin (B) and the crosslinking agent without hindering the action of the resin (A).

EXAMPLE 50

A mixture of 38 g (as solid content) of the resin (A-13) obtained in Synthesis Example 13, 200 g of zinc oxide, 0.020 g of Methine Dye (C) having the structure shown below, 0.30 g of maleic anhydride, and 300 g of toluene was dispersed in a ball mill for 4 hours and, after adding thereto 4 g of 1,3-xylylene diisocyanate, the resulting mixture was further dispersed in a ball mill for 10 minutes to prepare a coating composition for a photoconductive layer.

The coating composition was coated on a paper, which had been subjected to an electrically conductive treatment, by a wire bar at a dry coverage of 22 g/m$^2$, heated for 15 seconds at 100° C., and then heated for 2 hours at 120° C. Then, the coated paper was allowed to stand in the dark for 24 hours under the conditions of 20° C., 65% RH to obtain an electrophotographic light-sensitive material.

Methine Dye (C):

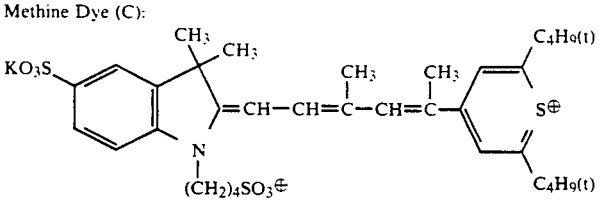

Characteristics of the electrophotographic light-sensitive material were measured in the same manner as in Example 49, and the results obtained are shown in Table 12 below.

TABLE 12

| | | |
|---|---|---|
| Smoothness of Surface Layer | | 515 (sec/cc) |
| Electrophotographic Characteristics | | |
| $V_{10}$ (−V) | I | 600 (V) |
| | II | 585 (V) |
| D.R.R (%) (120 sec. value) | I | 86% |
| | II | 82% |
| $E_{1/10}$ (erg/cm$^2$) | I | 30 |
| | II | 28 |
| Image-forming Performance | I, II | very good under both conditions |

TABLE 12-continued

| | |
|---|---|
| Printing Durability | 6,000 prints |

EXAMPLE 51 TO 58

Each of the electrophotographic light-sensitive materials was prepared by following the same procedure as described in Example 49 except that each of the resins and each of the crosslinking agents shown in Table 13 below were used in place of 10 g of the resin (A-6), 30 g of the resin (B-2), and the crosslinking agents, and 0.020 g of Cyanine Dye (D) having the structure shown below was used in place of the Cyanine Dye (B).

Cyanine Dye (D):

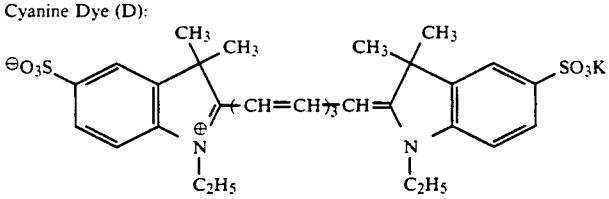

Characteristics of each of the electrophotographic light-sensitive materials were measured in the same manner as in Example 49, and the results obtained are shown in Table 13 below. In Table 13, the electrostatic characteristics measured under the environmental conditions of 30° C. and 80% RH are shown.

TABLE 13

| Example | Resin (A) 10 g | Resin (B) | 30 g |
|---|---|---|---|
| 51 | (A-2) | 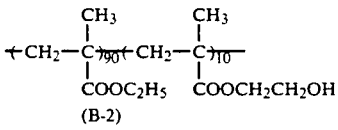 (B-2) | $\overline{M}w$ 38,000 |
| 52 | (A-3) | 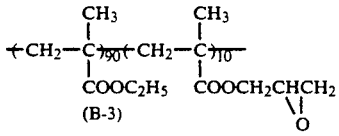 (B-3) | $\overline{M}w$ 40,000 |
| 53 | (A-7) | 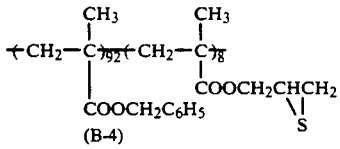 (B-4) | $\overline{M}w$ 41,000 |
| 54 | (A-9) | 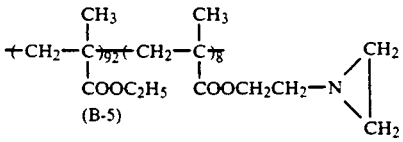 (B-5) | $\overline{M}w$ 38,000 |

TABLE 13-continued

| | | | |
|---|---|---|---|
| 55 | (A-15) | 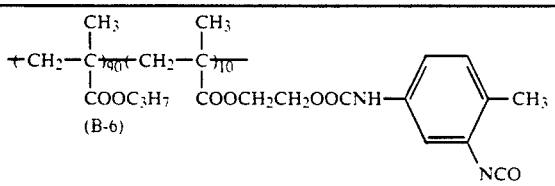 (B-6) | $\overline{M}w$ 37,000 |
| 56 | (A-9) | " | " |
| 57 | (A-10) | 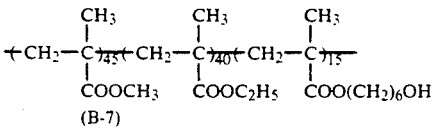 (B-7) | $\overline{M}w$ 42,000 |
| 58 | (A-17) | 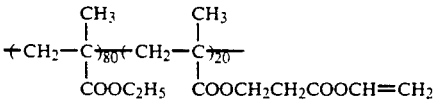 (B-8) | $\overline{M}w$ 55,000 |

| Example | Crosslinking Agent | | Electrostatic Characteristics (30° C., 80% RH) $V_{10}$ (−V) | D.R.R. (%) | $E_{1/10}$ (erg/cm$^2$) |
|---|---|---|---|---|---|
| 51 | 1,3-Xylylenediisocyanate | 1.5 g | 560 | 78 | 36 |
| 52 | 1,6-Hexamethylenediamine | 1.3 g | 605 | 82 | 28 |
| 53 | Terephthalic Acid | 1.5 g | 610 | 80 | 30 |
| 54 | 1,4-Tetramethylenediamine | 1.2 g | 570 | 80 | 27 |
| 55 | Polyethylene Glycol | 1.2 g | 550 | 75 | 31 |
| 56 | Polypropylene Glycol | 1.2 g | 560 | 76 | 30 |
| 57 | 1,6-Hexamethylene Diisocyanate | 2 g | 570 | 80 | 26 |
| 58 | Ethylene Glycol Dimethacrylate | 2 g | 560 | 78 | 35 |

As shown in Table 13, each of the electrophotographic light-sensitive materials of the present invention was excellent in the charging property, the dark charge retentivity, and the light sensitivity and provided clear images without the formation of background fog and the formation of cutting of fine lines even under severe conditions (30° C., 80% RH).

Also, when each of the imaged light-sensitive materials was used for printing as an offset master plate, more than 6,000 prints having clear images without background stains could be obtained.

EXAMPLES 59 TO 62

A mixture of 8 g of each of the resins (A) shown in Table 14 below, 20 g of each of Group X of the resins (B) shown in Table 13, 200 g of zinc oxide, 0.018 g of the above-described Cyanine dye (A), 0.30 g of maleic anhydride, and 300 g of toluene was dispersed in a ball mill for 4 hours. Then, 12 g of each of Group Y of the resins (B) shown in Table 13 was added thereto and the resulting mixture was dispersed for 10 minutes in a ball mill to obtain a coating composition for a photoconductive layer.

The coating composition was coated on a paper, which had been subjected .to an electrically conductive treatment, by a wire bar at a dry coverage of 25 g/m$^2$, heated to 100° C. for 15 seconds, and then heated to 120° C. for 2 hours. Then, the coated paper was allowed to stand in the dark for 24 hours under the conditions of 20° C. and 65% RH to obtain each of the electrophotographic light-sensitive materials.

TABLE 14

| Example | Resin (A) | Resin (B) group X | |
|---|---|---|---|
| 59 | (A-9) | 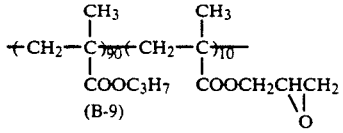 (B-9) | $\overline{M}w$ 42,000 |
| 60 | (A-15) | 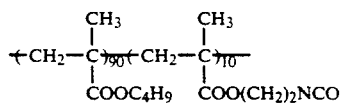 (B-11) | $\overline{M}w$ 45,000 |
| 61 | A-17 | 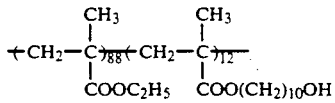 (B-12) | $\overline{M}w$ 38,000 |
| 62 | (A-18) | (B-10) | |

TABLE 14-continued

| Example | Resin (B) group Y | |
|---|---|---|
| 59 | $\overset{CH_3}{\underset{COOC_3H_7}{\underset{\vert}{C}}}_{92}$–$CH_2$–$\overset{CH_3}{\underset{COO(CH_2)_2NH_2}{\underset{\vert}{C}}}_{8}$ (B-10) | $\overline{M}w$ 38,000 |
| 60 | (B-10) | |
| 61 | $\overset{CH_3}{\underset{COOC_2H_5}{\underset{\vert}{C}}}_{85}$–$CH_2$–$\overset{CH_3}{\underset{COO(CH_2)_2OOCNH-C_6H_3(CH_3)-NCO}{\underset{\vert}{C}}}_{15}$ (B-13) | $\overline{M}w$ 46,000 |
| 62 | $\overset{CH_3}{\underset{COOC_4H_9}{\underset{\vert}{C}}}_{90}$–$CH_2$–$\overset{CH_3}{\underset{COOCH_2CH_2OCO-C_6H_3(C(=O)C(=O)O)}{\underset{\vert}{C}}}_{10}$ (B-14) | $\overline{M}w$ 33,000 |

Each of the electrophotographic light-sensitive materials of the present invention was excellent in the charging property, the dark charge retentivity, and the light sensitivity and at actual image formation, clear images having no background fog were obtained even under severe high temperature and high humidity conditions (30° C., 80% RH).

Furthermore, each imaged light-sensitive material was used for printing as an offset master plate, 6,000 prints having clear images were obtained.

EXAMPLE 63

A mixture of 10 g of the resin (A-5), 18 g of the resin (B-15) shown below, 200 g of zinc oxide, 0.50 g of Rose Bengale, 0.25 g of tetrabromophenol blue, 0.30 g of uranine, 0.30 g of tetrahydrophthalic anhydride and 240 g of toluene was dispersed in a ball mill for 4 hours, and, after further adding thereto 12 g of the resin (B-15) shown below, the resulting mixture was dispersed in a ball mill for 10 minutes to prepare a coating composition for a photoconductive layer.

The coating composition was then coated on a paper, which had been subjected to an electrically conductive treatment, by a-wire bar at a dry coverage of 20 g/m$^2$, heated to 110° C. for 30 seconds, and then heated to 120° C. for 2 hours. Then, the coated paper was allowed to stand in the dark for 24 hours under the conditions of 20° C., 65% RH to obtain an electrophotographic light-sensitive material.

Resin (B-15):

$\overset{CH_3}{\underset{COOCH_2C_6H_5}{\underset{\vert}{C}}}_{95}$–$CH_2$–$\overset{CH_3}{\underset{COO(CH_2)_2OCO(CH_2)_2COOH}{\underset{\vert}{C}}}_{5}$ $\overline{M}w$: 3.0 × 10$^4$ (weight composition ratio)

Characteristics of the light-sensitive material were measured in the same manner as in Example 47 and the results obtained were as follows.

| Smoothness of the photoconductive layer: 500 (cc/sec.) | | | |
|---|---|---|---|
| Electrostatic property | $V_{10}$ (V) | D.R.R. (%) | $E_{1/10}$ (lux · sec) |
| I (20° C., 65% RH) | 680 | 95 | 8.2 |
| II (30° C., 80% RH) | 660 | 93 | 9.0 |
| Image-forming Performance: | Good images were obtained under both the conditions of 20° C., 65% RH and 30° C., 80% RH. | | |
| Printing Durability: | 6,000 prints having good image quality were obtained. | | |

As described above, the electrophotographic light-sensitive material of the present invention had excellent electrophotographic characteristics and showed a high printing durability.

The evaluation of the electrostatic characteristics and the image-forming performance were conducted as follows.

Electrostatic Characteristics

After applying corona discharging onto each electrophotographic light-sensitive material using a paper analyzer (Paper Analyzer Type SP-428, trade name, made by Kawaguchi Denki K.K.) at −6 kV for 20 seconds in the dark under the conditions of 20° C. and 65% RH, the light-sensitive material was allowed to stand for 10 seconds and the surface potential $V_{10}$ in this case was measured. Then, after dark decaying the potential for 60 seconds, the retentivity of the potential, that is, the dark decay retentivity [DRR (%)]was obtained by the formula $(V_{70}/V_{10})\times 100$ (%).

Also, after charging the surface of the photoconductive layer to −400 volts by corona discharging, the surface of the photoconductive layer was irradiated by visible light of 2.0 lux, the time required to decaying the surface potential ($V_{10}$) to 1/10 thereof was determined and the exposure amount $E_{1/10}$ (lux·second) was calculated therefrom.

Image-forming Performance

Each of the electrophotographic light-sensitive materials was image-exposed and developed by a full automatic processor, ELP 404V (trade name, made by Fuji Photo Film Co., Ltd.) using ELP-T (trade name, made by the aforesaid company) as a toner to form toner images.

EXAMPLES 64 TO 65

A mixture of 6.3 g of each of the resin (A - 22) and the resin (A-23), 33.7 g of each of the resins (B) shown in Table 15 below, 200 g of zinc oxide, 0.02 g of uraine, 0.04 g of Rose Bengale, 0.03 g of bromophenol blue, 0.40 g of phthalic anhydride, and 300 g of toluene was dispersed in a ball mill for 4 hours to prepare a coating composition for a photoconductive layer. The coating composition was coated on a paper, which had been subjected to an electrically conductive treatment, by a wire bar at a dry coverage of 24 g/m$^2$, dried for one minute at 110° C., and after exposing the layer with a high-pressure mercury lamp for 3 minutes, the coated paper was allowed to stand for 24 hours under the conditions of 20° C., 65% RH to obtain each electrophotographic light-sensitive material.

The characteristics of the electrophotographic light-sensitive materials are shown in Table 16 below.

TABLE 15

| Example | Resin (A) | Resin (B) |
|---|---|---|
| 64 | (A-22) | 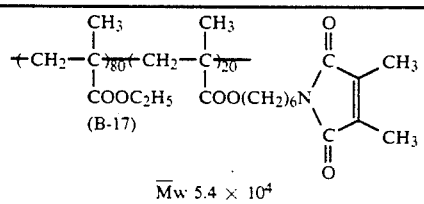 (B-17) $\overline{M}w$ 5.4 × 10$^4$ |
| 65 | (A-23) | 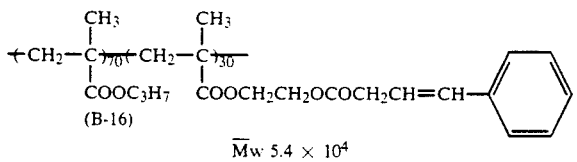 (B-16) $\overline{M}w$ 5.4 × 10$^4$ |

TABLE 16

| Example | Smoothness (cc/sec) | $V_{10}$ (−V) | D.R.R. (%) | $E_{1/10}$ (lux · sec) | Printing Durability |
|---|---|---|---|---|---|
| 64 | 485 | 550 | 88 | 10.6 | 6,000 prints |
| 65 | 500 | 610 | 95 | 9.3 | 5,000 prints |

The electrophotographic light-sensitive materials of the present invention were excellent in the charging property, and dark charge retentivity, and the light sensitivity and at actual image formation, clear images having no background fog were obtained even under severe conditions of high temperature and high humidity (30° C., 80% RH).

Furthermore, when the imaged light-sensitive material was used for printing as an offset master plate, 5,000 to 6,000 prints having clear images were obtained.

EXAMPLES 66 TO 74

A mixture of 6.5 g of each of the resins (A) shown in Table 17 below, 33.g g of each of the resins (B) shown in the Table 17, 200 g of zinc oxide, 0.05 g of Rose Bengale, 0.03 g of tetrabromophenol blue, 0.02 g of uranine, 0.01 g of phthalic anhydride, and 240 g of toluene was dispersed in a ball mill for 2 hours and, after adding thereto each of the crosslinking agents shown in the Table 17 in the amount shown in the table, the resulting mixture was further dispersed in a ball mill for 10 minutes to prepare a coating composition for a photoconductive layer. The coating composition was coated on a paper, which had been subjected to electrically conductive treatment, by a wire bar at a dry coverage of 18 g/m$^2$, heated to 110° C. for 30 seconds, and then heated to 120° C. for 2 hours. Then, the coated paper was allowed to stand in the dark for 24 hours under the conditions of 20° C. and 65% RH to obtain each of the electrophotographic light-sensitive materials.

TABLE 17

| Example | Resin (A) | Resin (B) | Crosslinking Agent (amount) |
|---|---|---|---|
| 66 | (A-1) | (B-1) | Glutaconic acid (4 g) |
| 67 | (A-2) | (B-2) | 1,3-Xylylene diisocyanate (3 g) |
| 68 | (A-3) | (B-6) | Ethylene glycol (1.5 g) |
| 69 | (A-5) | (B-8) | Ethylene glycol diacrylate (3 g) |
| 70 | (A-11) | (B-3) | Succinic acid (3.8 g) |
| 71 | (A-12) | (B-1) | — (0 g) |
| 72 | (A-16) | (B-11) | — (0 g) |
| 73 | (A-20) | (B-8) | 1,6-Hexane diisocyanate (3 g) |
| 74 | (A-21) | (B-3) | Gluconic acid (3.8 g) |

Each of the electrophotographic light-sensitive materials of the present invention was excellent in the charging property, the dark charging retentivity, and the light sensitivity and at actual image formation, clear images having no background fog were obtained even under severe conditions of high temperature and high humidity (30° C., 80% RH).

Furthermore, when each imaged light-sensitive material was used for printing as an offset master plate, 8,000 prints having clear image quality were obtained.

As described above, according to the present invention, an electrophotographic light-sensitive material having excellent electrostatic characteristics (in particular, under severe conditions), giving images having clear and good image quality, and having a high mechanical strength can be obtained. In particular, the electrophotographic light-sensitive material of the present invention is effective for a scanning exposure system using a semiconductor laser light.

Also, by using the repeating unit containing the specific methacrylate component shown by formula (Ia) or (Ib) for the resin used in the present invention, the electrostatic characteristics are more improved.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material having a photoconductive layer containing at least an inorganic photoconductive substance and a binder resin, wherein said binder resin contains an AB block copolymer having a weight average molecular weight of from $1\times10^3$ to $2\times10^4$ and composed of a first block comprising at least one polymer component containing from 0.5 to 20 parts by weight of at least one acidic group selected from $-PO_3H_2$, $-COOH$, $-SO_3H$, a phenolic hydroxy group,

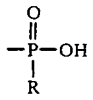

(wherein R represents a hydrocarbon group or —OR' (wherein R' represents a hydrocarbon group)) and a cyclic acid anhydride-containing group, and a second block having no acidic group containing at least a polymer component represented by the following formula (I):

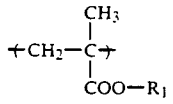

(I)

wherein $R_1$ represents a hydrocarbon group, and wherein said polymer component represented by formula (I) is present in an amount from 30 to 100% by weight based on total weight of said second block.

2. The electrophotographic light-sensitive material of claim 1, wherein said binder resin further contains from 1 to 30% by weight of a repeating unit containing a heat- and/or photo-curable functional group as a copolymer component.

3. The electrophotographic light-sensitive material of claim 1, wherein the binder resin further contains a heat- and/or photo-curable resin (B).

4. The electrophotographic light-sensitive material of claim 1, wherein the binder resin further contains a crosslinking agent.

5. The electrophotographic light-sensitive material of claim 1, wherein the binder resin further contains a resin (C) which has a weight average molecular weight of from $5\times10^4$ to $5\times10^5$ and does not contain $-PO_3H_2$, $-COOH$, $-SO_3H$, phenolic —OH,

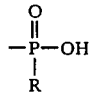

(wherein R is the same as defined above), a cyclic acid anhydride-containing group, and a basic group.

6. The electrophotographic light-sensitive material of claim 1, wherein the binder resin further contains a resin (D) which has a weight average molecular weight of from $5\times10^4$ to $5\times10^5$ and contains from 0.1 to 15% by weight of a copolymer component containing at least one kind of substituent selected from —OH and a basic group.

7. The electrophotographic light-sensitive material of claim 1, wherein the binder resin further contains a resin (E) which has a weight average molecular weight of from $5\times10^4$ to $5\times10^5$ and containing a copolymer component containing an acidic group at a content of not more than 50% of the content of the acidic group contained in said AB block copolymer or a resin having a weight average molecular weight of from $5\times10^4$ to $5\times10^5$ and containing a copolymer component containing at least one kind of an acidic group selected from $-PO_3H_2$, $-SO_3H$, $-COOH$, and

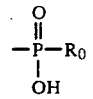

(wherein $R_o$ represents a hydrocarbon group or $-OR_o'$ (wherein $R_o'$ represents a hydrocarbon group)), said acidic group having a larger pKa than the pKa of the acidic group contained in said AB block copolymer.

8. An electrophotographic light-sensitive material having a photoconductive layer containing at least an inorganic photoconductive substance and a binder resin, wherein said binder resin contains an AB block copolymer having a weight average molecular weight of from $1\times10^3$ to $2\times10^4$ and composed of a first block comprising at least one polymer component containing from 0.5 to 20 parts by weight of at least one acidic group selected from $-PO_3H_2$, $-COOH$, $-SO_3H$, a phenolic hydroxy group,

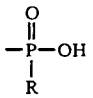

(wherein R represents a hydrocarbon group or —OR' (wherein R' represents a hydrocarbon group)) and a cyclic acid anhydride-containing group, and a second block containing at least a polymer component represented by the following formula (I):

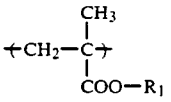

(I)

wherein $R_1$ represents a hydrocarbon group, and wherein the second block in the AB block copolymer contains at least 30% of weight of at least one repeating ring unit selected from those represented by the following formula (Ia) and formula (Ib):

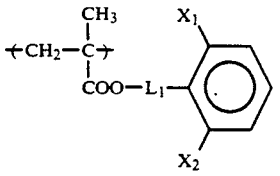

(Ia)

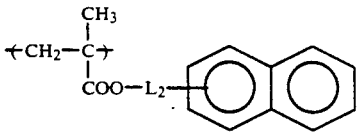

(Ib)

wherein $X_1$ and $X_2$ each, independently, represents a hydrogen ato. a hydrocarbon group having from 1 to 10 carbon atoms. a chlorine atom. a bromine atom, $—COZ_2$ or $—COOZ_2$ (wherein $Z_2$ represents a hydrocarbon group having from 1 to 10 carbon atoms) and $L_1$ and $L_2$ each represents a single bond or a linkage group having from 1 to 4 linking atoms for bonding —COO— and the benzene ring.

* * * * *